US009968166B2

(12) United States Patent
Inukai

(10) Patent No.: US 9,968,166 B2
(45) Date of Patent: May 15, 2018

(54) SLIDER COVER FOR SLIDE FASTENER

(71) Applicant: YKK Corporation, Tokyo (JP)

(72) Inventor: Takayuki Inukai, Toyama (JP)

(73) Assignee: YKK Corporation (JP)

( * ) Notice: Subject to any disclaimer, the term of this patent is extended or adjusted under 35 U.S.C. 154(b) by 0 days. days.

(21) Appl. No.: 15/506,488

(22) PCT Filed: Sep. 1, 2014

(86) PCT No.: PCT/JP2014/072958
§ 371 (c)(1),
(2) Date: Feb. 24, 2017

(87) PCT Pub. No.: WO2016/035125
PCT Pub. Date: Mar. 10, 2016

(65) Prior Publication Data

US 2017/0280834 A1 Oct. 5, 2017

(51) Int. Cl.
*A44B 19/26* (2006.01)

(52) U.S. Cl.
CPC ..... *A44B 19/265* (2013.01); *A44B 19/262* (2013.01); *A44B 19/26* (2013.01)

(58) Field of Classification Search
CPC ..... A44B 19/265; A44B 19/262; A44B 19/26; Y10T 24/2561; Y10T 24/2582; Y10T 24/2588; Y10T 24/2591
See application file for complete search history.

(56) References Cited

U.S. PATENT DOCUMENTS 2,855,652 A * 10/1958 Jones ..... A44B 19/265 24/426
2,933,792 A 4/1960 Malmborg
(Continued)

FOREIGN PATENT DOCUMENTS

JP S48-004036 A 1/1973
JP 120814/1991 A 12/1991
(Continued)

OTHER PUBLICATIONS

International Search Report, PCT International Patent Application No. PCT/JP2014/072958, dated Nov. 25, 2014.
(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

There is provided a slide cover for a slide fastener. A pair of second guide element passages are formed in a space among an upper plate, a lower plate, a pair of outer wall portions and a pair of inner wall portions to guide a pair of separated element rows into a first element guide passage of a slider. The upper plate, the lower plate and a connection post have a concave surface, which is recessed in a disengaging direction of the slider, in a surface facing toward an engaging direction of the slider. The pair of second guide element passages are configured so that tip ends of the pair of inner wall portions in the engaging direction are located at the same positions as or at a side of the engaging direction relative to tip ends of the pair of outer wall portions in the engaging direction.

9 Claims, 12 Drawing Sheets

(56) References Cited

U.S. PATENT DOCUMENTS

| | | | | |
|---|---|---|---|---|
| 4,819,308 | A * | 4/1989 | Baroky | A44B 19/265 24/415 |
| 4,976,120 | A * | 12/1990 | Terada | A44B 19/301 70/312 |
| 6,701,584 | B2 | 3/2004 | Metzger | |
| 7,039,989 | B2 * | 5/2006 | Marty | A41D 15/04 24/382 |
| 9,763,498 | B2 * | 9/2017 | Kojima | A44B 19/26 |
| 2016/0295973 | A1 * | 10/2016 | Yamazaki | A44B 19/26 |

FOREIGN PATENT DOCUMENTS

| | | | |
|---|---|---|---|
| JP | 2005-160785 | A | 6/2005 |
| WO | 2014-033926 | A1 | 3/2014 |

OTHER PUBLICATIONS

Written Opinion, PCT International Patent Application No. PCT/JP2014/072958, dated Nov. 25, 2014.

* cited by examiner

SLIDER COVER FOR SLIDE FASTENER

This application is a national stage application of PCT/JP2014/072958, which is incorporated herein by reference.

TECHNICAL FIELD

The present invention relates to a slide cover to be mounted to a slider for a slide fastener.

BACKGROUND ART

A usual slide fastener engages a pair of element rows when a slider is moved forward. However, while the slider is moved forward, a cloth may be jammed in a slider body.

Therefore, a slider configured to make it difficult for the cloth to be jammed in the slider body has been known. For example, as an example of the conventional slider, a slider has been known in which a slider body is formed by front and back plates arranged to face each other, a central member configured to connect the front and back plates and side plates protruding from right and left sides of the front and back plates and a surface (front surface) of the slider body facing toward an engaging direction is configured as a concave surface (Patent Document 1). When the slider is moved in the engaging direction, even though the cloth is between (inside) the pair of element rows, the cloth is guided toward a bottom-side of the concave surface as the slider is moved and finally passes under the slider. In this way, the slider prevents jamming of the cloth.

Also, as an example of a slide cover to be mounted to the slider, a slide cover has been known which has upper and lower plates arranged to face each other in an upper-lower direction, a connection post configured to connect the upper plate and the lower plate, an accommodation portion provided in the upper plate and configured to accommodate therein an upper blade of the slider and a pair of element passages provided at right and left sides of the connection post (Patent Document 2). At an entry edge portion of the element passage, an angle between front surfaces of the upper and lower plates and an axis line (an extension direction of the passage) of the element passage is set within a predetermined range, so that the slide cover is difficult to jam the cloth therein. Further, in FIGS. 6 and 8 of Patent Document 2, the front surfaces of the upper and lower plates are configured as convex surfaces each of which has an opposite shape to the front plate of Patent Document 1, i.e., an inverted V shape. Therefore, when the slider is moved in the engaging direction, the cloth located at the engaging direction-side of the slide cover moves along the convex surfaces as the slider moves and divides to the right and left sides of the slide cover. In this way, the slider prevents the jamming of the cloth.

PRIOR ART DOCUMENT

Patent Document

Patent Document 1: Japanese Patent Application Publication No. 2005-160785A

Patent Document 2: International Patent Application Publication No. WO2014/033926

SUMMARY OF INVENTION

Problems to be Solved by Invention

However, according to the slider disclosed in Patent Document 1, both ends of the V-shaped concave surface are located at outer sides relative to the pair of element rows. More specifically, the right and left sides of the concave surface are formed by side plates, and the pair of side plates is configured to guide outer sides of the pair of element rows. Thus, in a case where the cloth is covered from lower sides of the pair of element rows to upper sides of the pair of element rows via a space between the pair of element rows, for example, when the slider is moved in the engaging direction, the cloth located at the outer side of the pair of element rows is guided between the element rows and the side plates located at the outer side of the element rows, so that it may be jammed. Also, right and left end portions of the V-shaped concave surface form right and left end portions of the slider body and protrude forward at an acute angle. Therefore, the end portions may be damaged. Also, when the skin of a person is touched with the corresponding end portions, the person may be injured.

Also, according to the slider cover disclosed in Patent Document 2, an apex of the inverted V-shaped convex surface is located at a tip end of the front surface of the slider. Thus, for example, when the slider is moved in the engaging direction at a state where the cloth is located between the pair of element rows, the cloth located at the inner side of each element row is guided between the element row and the connection post located at the inner side thereof, so that the cloth may be jammed.

Further, in order to separate the pair of engaged element rows, which is not the jamming of the cloth, the pair of element rows may be pulled so that they are spaced from each other, or one element row may be pulled with holding the one element row and a pull tab of the slider.

However, according to the slider disclosed in Patent Document 1, a part configuring the engaging direction-side tip end of the slider is the right and left side plates of the slider. Therefore, when pulling the slider in a direction along which the pair of element rows separates, the right and left side plates prohibit the pair of element rows from moving horizontally, thereby deteriorating separability of the pair of element rows, i.e., sliding properties of the slider upon opening of the slide fastener (hereinafter, referred to as "the sliding properties of the slider").

The present invention has been made in view of the above situations and an object of the present invention is to provide a slide cover configured to make it difficult for a cloth to be jammed and having sliding properties of the slider.

Means for Solving Problems

A slide cover for a slide fastener of the present invention is mounted to a slider including a slider body having upper and lower blades arranged to face each other with an interval in an upper-lower direction, a guide post configured to connect front portions of the upper blade and the lower blade at intermediate portions in a right and left direction, and a Y-shaped first element guide passage formed by the upper blade, the lower blade and the guide post.

The slide cover of the present invention includes an upper plate mounted to the upper blade, a lower plate mounted to the lower blade, a connection post configured to connect the upper plate and the lower plate in the upper-lower direction and including a pair of inner wall portions configured to respectively guide engaging portion-sides of a pair of element rows of the slide fastener, a pair of outer wall portions configured to respectively guide opposite sides of the pair of element rows to the engaging portion-sides and protruding from at least one of the upper plate and the lower plate so as to narrow an interval between the upper plate and the lower plate, and a pair of second guide element passages formed in a space among the upper plate, the lower plate, the pair of outer wall portions and the pair of inner wall portions and configured to guide the pair of separated element rows into the first element guide passage. The upper plate, the lower plate and the connection post have a concave surface, which is recessed in a disengaging direction of moving directions of the slider, in a surface thereof facing toward an engaging direction of the moving directions of the slider. Also, the pair of second guide element passages are configured so that tip ends of the pair of inner wall portions in the engaging direction are located at the same positions as tip ends of the pair of outer wall portions in the engaging direction or located at the side of the engaging direction relative to the tip ends of the pair of outer wall portions in the engaging direction.

The pair of second guide element passages are not particularly limited with respect to intervals between the facing outer and inner wall portions. For example, the intervals may be constant in an extension direction of the second element guide passages but are preferably configured as follows, so as to easily guide each element into the slider while making it difficult for a cloth to be jammed.

That is, the pair of second guide element passages are configured so that the intervals between the facing outer and inner wall portions become narrower toward a tip end portion-side thereof in the engaging direction relative to the disengaging direction-side thereof.

Regarding the interval between the facing outer wall and inner wall portions, shapes of the outer and inner wall portions are preferably configured as follows.

That is, as seen in the upper-lower direction, an inner surface shape of each of the outer wall portions is one linear shape, an inner surface shape of each of the inner wall portions is a bent shape including a first linear portion arranged at the engaging direction-side and a second linear portion arranged at the disengaging direction-side, the second linear portion has a shape parallel with the inner surface shape of each of the outer wall portions, and the first linear portion has a shape inclined relative to the inner surface shape of each of the outer wall portions and coming close to each of the outer wall portions toward the tip end portion-side in the engaging direction.

Also, in order to improve connection strength between the upper plate and the lower plate, a following configuration is preferable.

That is, the upper plate and the lower plate are configured as separate members. The connection post has a concave wall portion forming the concave surface and a connection portion configured to connect the upper plate and the lower plate in the upper-lower direction at a side of the disengaging direction relative to the concave wall portion. Also, the concave wall portion has an upper concave wall portion configuring an upper side of the concave surface and protruding downward from the upper plate and a lower concave wall portion configuring a lower side of the concave surface and protruding upward from the lower plate. The upper concave wall portion and the lower concave wall portion overlap with each other in the upper-lower direction, overlapping surfaces-side thereof are respectively provided with a first groove portion and a first ridge portion to be fitted to the first groove portion, and the first groove portion and the first ridge portion are located at the side of the engaging direction relative to the connection portion.

The upper plate may be an arbitrary plate that can be mounted to the upper blade. However, from a standpoint of preventing jamming of a cloth, the pair of second guide element passages is preferably arranged at desired positions with respect to the slider. To this end, following configurations are preferable.

That is, the upper plate has an upper mounting portion to be mounted to the upper blade, and the upper mounting portion has an upper surrounding portion configured to surround a part of an outer periphery of the upper blade and an upper covering portion configured to cover at least a part of an upper surface of the upper blade. The upper surrounding portion configures an outer side of an upper hole penetrating the upper plate.

Also, in order to arrange the pair of second guide element passages at desired positions with respect to the slider, a shape of the slider is preferably used, as follows.

That is, in this case, the slider includes the slider body having a pull tab attachment portion protruding from the upper surface of the upper blade, in addition to the upper blade, the lower blade, the guide post and the first element guide passage. The slide cover to be mounted to the slider is configured so that the upper covering portion has a pair of upper protruding portions protruding from the pair of second guide element passages of the upper plate so as to narrow the upper hole. An interval between the pair of upper protruding portions is set to a dimension within which the pull tab attachment portion provided on the upper surface-side of the upper blade is interposed.

The lower plate may be an arbitrary plate that can be mounted to the lower blade. However, from the standpoint of preventing the jamming of the cloth, the pair of second guide element passages is preferably arranged at desired positions with respect to the slider. To this end, following configurations are preferable.

That is, the lower plate has a lower mounting portion to be mounted to the lower blade, and the lower mounting portion has a lower surrounding portion configured to surround a part of an outer periphery of the lower blade and a lower covering portion configured to cover at least a part of a lower surface of the lower blade. The lower surrounding portion configures an outer side of a lower hole penetrating the lower plate.

Also, in order to arrange the pair of second guide element passages at desired positions with respect to the slider, a shape of the slider is preferably used, as follows.

That is, in this case, the slider includes the slider body having a pull tab attachment portion protruding from the lower surface of the lower blade, in addition to the upper blade, the lower blade, the guide post and the first element guide passage. The slide cover to be mounted to the slider is configured so that the lower covering portion has a pair of lower protruding portions protruding from the pair of second guide element passages so as to narrow the lower hole. An interval between the pair of lower protruding portions is set to a dimension within which the pull tab attachment portion provided on the lower surface-side of the lower blade is interposed.

Also, the upper plate and the lower plate are preferably configured, as follows, for easy mounting to the upper blade and the lower blade.

That is, the upper plate has a pair of upper guide portions configured to guide upper surfaces-side of the pair of element rows, an upper bonding portion bonding the pair of upper guide portions, and an upper mounting portion formed in cooperation with the pair of upper guide portions and the upper bonding portion and configured to mount the upper plate to the upper blade. The upper mounting portion has a pair of upper leg portions protruding from the pair of upper guide portions in the disengaging direction and configured to interpose the upper blade therebetween, in addition to the pair of upper guide portions and the upper bonding portion. The lower plate has a pair of lower guide portions configured to guide lower surfaces-side of the pair of element rows, a lower bonding portion bonding the pair of lower guide portions, and a lower mounting portion formed in cooperation with the pair of lower guide portions and the lower bonding portion and configured to mount the lower plate to the lower blade. The lower mounting portion has a pair of lower leg portions protruding from the pair of lower guide portions in the disengaging direction and configured to interpose the lower blade therebetween, in addition to the pair of lower guide portions and the lower bonding portion. The pair of upper leg portions and the pair of lower leg portions have elasticity so that the upper blade and the lower blade are to be mounted therebetween in a snap manner, respectively.

Advantageous Effects of Invention

According to the present invention, the concave surface, which is recessed in the disengaging direction of the moving directions of the slider, is provided in the surface facing toward the engaging direction of the moving directions of the slider. Therefore, when the slider is moved in the engaging direction, the cloth positioned between the pair of element rows moves toward the concave surface, so that the cloth is difficult to be jammed therebetween. Also, according to the present invention, the tip ends of the pair of inner wall portions in the engaging direction are located at the same positions as the tip ends of the pair of outer wall portions in the engaging direction or located at the side of the engaging direction relative to the tip ends of the pair of outer wall portions in the engaging direction, so that the pair of outer wall portions does not form a part of the concave surface. Therefore, as compared to a configuration where the pair of outer wall portions forms a part of the concave surface, the cloth is more difficult to be jammed. Also, according to the present invention, as compared to a configuration where the tip ends of the pair of inner wall portions in the engaging direction are located at closer sides in the disengaging direction than the tip ends of the pair of outer wall portions in the engaging direction, the sliding properties of the slider is improved when a fastener is opened by pulling a pair of tapes, to which the element rows are fixed, toward both sides.

Also, in the case of the slide cover where the pair of second guide element passages is configured so that the intervals between the facing outer and inner wall portions become narrower toward the tip end portion-side in the engaging direction relative to the disengaging direction-side, it is possible to easily guide each element row into the slider while making it possible for the cloth to be jammed.

Also, in the case of the slide cover where the upper plate and the lower plate are configured as separate members, and the connection post has the concave wall portion forming the concave surface and the connection portion configured to connect the upper plate and the lower plate in the upper-lower direction, the first groove portion and the first ridge portion provided at the upper concave wall portion and lower concave wall portion configuring the concave wall portion are located at the side of the engaging direction relative to the connection portion. Therefore, even when a force of separating the upper plate and the lower plate in the upper-lower direction is applied from end portions in the disengaging direction of the upper plate and the lower plate so as to separate the upper plate and the lower plate, since a bottom surface (a surface facing toward the engaging direction) of the first groove portion and the first ridge portion are contacted to each other, the upper concave wall portion and the lower concave wall portion are difficult to separate from each other, so that the connection strength between the upper plate and the lower plate is improved.

Also, according to the slide cover where the upper plate has the upper mounting portion and the upper mounting portion has the upper surrounding portion and the upper covering portion, the upward positioning of the slide cover with respect to the slider is made by the upper covering portion, and the pair of second guide element passages is arranged at the desired positions with respect to the slider, so that the jamming of the cloth can be prevented.

Also, according to the slide cover where the upper covering portion has the pair of upper protruding portions, when the slide cover is mounted to the slider having the pull tab attachment portion on the upper surface of the upper blade, the positioning of the slide cover with respect to the pull tab attachment portion is made by the interval between the pair of upper protruding portions. Therefore, the pair of element guide passages is arranged at the desired positions with respect to the slider, so that the jamming of the cloth can be prevented.

Also, according to the slide cover where the lower plate has the lower mounting portion and the lower mounting portion has the lower surrounding portion and the lower covering portion, the downward positioning of the slide cover with respect to the slider is made by the lower covering portion, and the pair of second guide element passages is arranged at the desired positions with respect to the slider, so that the jamming of the cloth can be prevented.

Also, according to the slide cover where the lower covering portion has the pair of lower protruding portions, when the slide cover is mounted to the slider having the pull tab attachment portion on the lower surface of the lower blade, the positioning of the slide cover with respect to the pull tab attachment portion is made by the interval between the pair of lower protruding portions. Therefore, the pair of element guide passages is arranged at the desired positions with respect to the slider, so that the jamming of the cloth can be prevented.

Also, according to the slide cover having the pair of upper leg portions configured to interpose therebetween the upper blade and the pair of lower leg portions configured to interpose therebetween the lower blade, it is possible to mount the upper blade and the lower blade in the snap manner by the elasticity of the pair of upper leg portions and the pair of lower leg portions, so that it is possible to easily mount the slide cover.

EMBODIMENTS OF INVENTION

Figure 1:
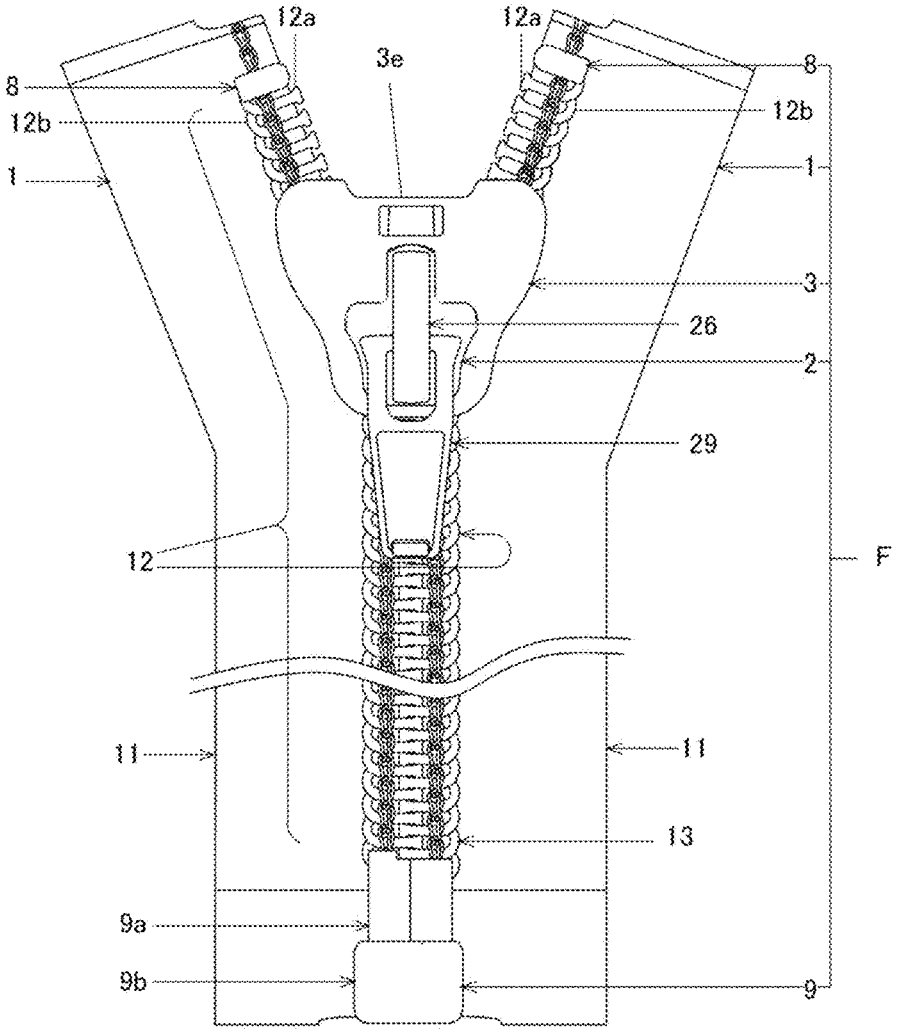
FIG. 1 is a plan view depicting a slide fastener to which a slide cover in accordance with a first illustrative embodiment of the present invention is applied.

As shown in FIG. 1, a slide fastener F to which the present invention is to be applied has a pair of fastener stringers 1, 1 extending in parallel, a slider 2 configured to be moveable along facing side edge portions of the pair of fastener stringers 1, 1, a slide cover 3 mounted to the slider 2, and first and second end stops 8, 9 configured to define a moving range of the slider 2 at both end portions in a length direction along which the pair of fastener stringers 1, 1 extends.

When the slider 2 is moved in one direction of the length direction, the pair of fastener stringers 1, 1 can be closed. When the slide reaches one limit position of the moving range, the slider 2 collides with the first end stops 8. Also, when the slider 2 is moved in the other direction of the length direction, the pair of fastener stringers 1, 1 can be open. When the slide reaches the other limit position of the moving range, the slider 2 collides with the second end stop 9.

Hereinafter, when describing the directions, the length direction is also referred to as a front-rear direction. A front direction indicates an upper direction in FIG. 1 along which the slider 2 closes the pair of fastener stringers 1, 1, and a rear direction indicates a lower direction in FIG. 1 along which the slider 2 opens the pair of fastener stringers 1, 1. Also, when the pair of fastener stringers 1, 1 is closed, a pair of element rows 12, 12 (which will be described later) is engaged. Therefore, the front direction is also referred to as an engaging direction. Also, when the pair of fastener stringers 1, 1 is opened, the pair of element rows 12, 12 is separated. Therefore, the rear direction is also referred to as a disengaging direction. Also, a right and left direction indicates a direction which is orthogonal to the length direction (front-rear direction) and along which the pair of fastener stringers 1, 1 is aligned, and is also referred to as a width direction. A left side indicates a left side in FIG. 1, and a right side indicates a right side in FIG. 1. Also, the facing surfaces of the pair of element rows 12, 12 are also referred to as engaging portion-sides of the pair of element rows 12, 12. That is, for the left element row 12, the facing surface is a right surface, and for the right element row 12, the facing surface is a left surface. Also, opposite surfaces of the pair of element rows 12, 12 to the facing surfaces are also referred to as opposite sides of the pair of element rows 12 to the engaging portions-sides, 12. That is, for the left element row 12, the opposite surface is a left surface, and for the right element row 12, the opposite surface is a right surface. Also, a direction orthogonal to the front-rear direction and the right and left direction is referred to as an upper-lower direction (a thickness direction). An upper side indicates a front side of a direction orthogonal to the drawing sheet of FIG. 1, i.e., a direction orthogonal to the front-rear direction and the right and left direction, and a lower side indicates an inner side of the direction orthogonal to the drawing sheet of FIG. 1.

The pair of fastener stringers 1, 1 has a pair of tapes 11, 11 extending in the front-rear direction and arranged in the right and left direction, and a pair of element rows 12, 12 fixed along the right and left facing side edge portions of the pair of tapes 11, 11.

Each of the tapes 11 has a band shape long in the front-rear direction and a thickness direction thereof is the upper-lower direction.

Each of the element rows 12 is formed by a plurality of elements 13 fixed with an interval in the front-rear direction along the facing side edge portion of the tape 11. Meanwhile, in the first illustrative embodiment, each element row 12 is formed by a coil element obtained by forming a mono filament into a coil shape, and is sewn to an upper surface of the tape 11 with engaging portions 12*a* of the element row 12 being arranged at an outer side in a width direction of the tape 11 and coil reverse portions 12*b* of the element row 12 located at an opposite side to the engaging portions 12*a* being arranged at a central side in the width direction of the tape 11. In the meantime, the coil element is formed by the plurality of continuous elements 13. In the first illustrative embodiment, as the element row 12, the coil element is used. However, the present invention is not limited thereto. For example, the element row 12 may be configured by arranging a plurality of independent element side by side.

When the slider 2 is forward moved so as to close the pair of fastener stringers 1, 1, the elements 13, 13 of the pair of element rows 12, 12 are engaged each other and the slider 2 collides with the first end stops 8, so that the slider 2 is prohibited from moving further forward. Also, when the slider 2 is moved rearward so as to open the pair of fastener stringers 1, 1, the elements 13, 13 of the pair of element rows 12, 12 separate from each other in the right and left direction and the slider 2 collides with the second end stop 9, so that the slider 2 is prohibited from moving further rearward.

The slider 2 has a slider body 21 configured to engage with the pair of element rows 12, 12 and to be moveable in the front-rear direction and upper and lower pull tabs 29, 29 connected to the slider body 21.

The slider body 21 has an upper blade 22 and a lower blade 23 arranged to face each other with an interval in the upper-lower direction, a guide post 24 configured to connect facing front portions of the upper blade 22 and the lower blade 23 at intermediate portions thereof in the right and left direction, flanges 25, 25, 25, 25 protruding from right and left end portions of at least one (two blades, in the first illustrative embodiment) of the upper blade 22 and the lower blade 23 in a direction along which an upper-lower facing interval is narrowed, a pull tab attachment portion 26 protruding from an upper surface of the upper blade 22, and a pull tab attachment portion 27 protruding from a lower surface of the lower blade 23.

Also, the slider body 21 has a Y-shaped element guide passage 2*a*, which is an internal space of the slider body, penetrates the slider body in the front-rear direction and is bisected at a front side thereof, and a pair of tape grooves 2*d*, 2*d* configured to communicate with the element guide passage 2*a* and to open in the right and left direction. In the meantime, the front side of the element guide passage 2*a* is formed with two openings 2*b*, 2*b* each of which is referred to as a shoulder mouth, and a rear side of the element guide passage 2*a* is formed with one opening 2*c* which is referred to as a rear mouth. In the meantime, the element guide passage 2*a* of the slider body 21 is also referred to as the first element guide passage 2*a*. The pair of element rows 12, 12 passes through the first element guide passage 2*a*, and the corresponding tapes 11 pass through the respective tape grooves 2*d*.

Also, the slider body 21 has a shape where a front surface including the pair of shoulder mouths 2*b*, 2*b* is convex into an arc shape and the rear mouth 2*c* is narrower than the pair of shoulder mouths 2*b*, 2*b*. More specifically, both side edges of the upper blade 22 and the lower blade 23 are also formed so that the shoulder mouth 2*b*-side is wide and the rear mouth 2*c*-side is narrow, in conformity to the shape of the element guide passage 2*a*. That is, portions, which are closer to the rear mouth 2*c* than the shoulder mouth 2*b*, of both side edges of the upper blade 22 and the lower blade 23 are formed with concave portions 22*a*, 23*a* recessed toward a center-side in the width direction. More specifically, each of the upper and lower concave portions 22*a*, 23*a* has a shape gradually extending toward an inner side in the width direction from a front end toward the rear and then extending in parallel with the front-rear direction. Also, both side edges of the four flanges 25 protruding along both side edges of the upper blade 22 and the lower blade 23 are recessed to conform to the shape of both side edges of the upper blade 22 and the lower blade 23, thereby forming the concave portions 22*a*, 23*a*.

Figure 2:
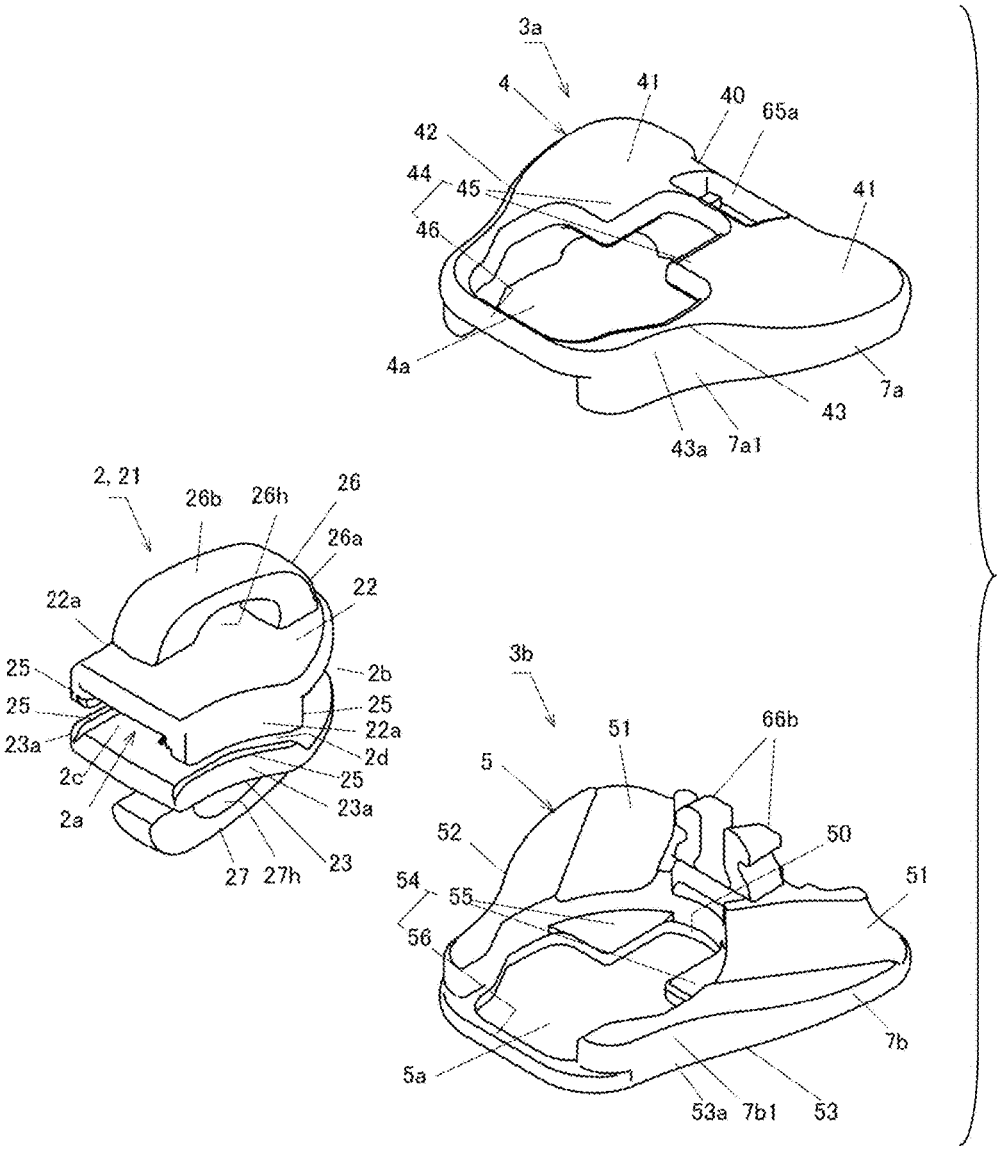
FIG. 2 is an exploded perspective view of the slide cover in accordance with the first illustrative embodiment.
Figure 7:
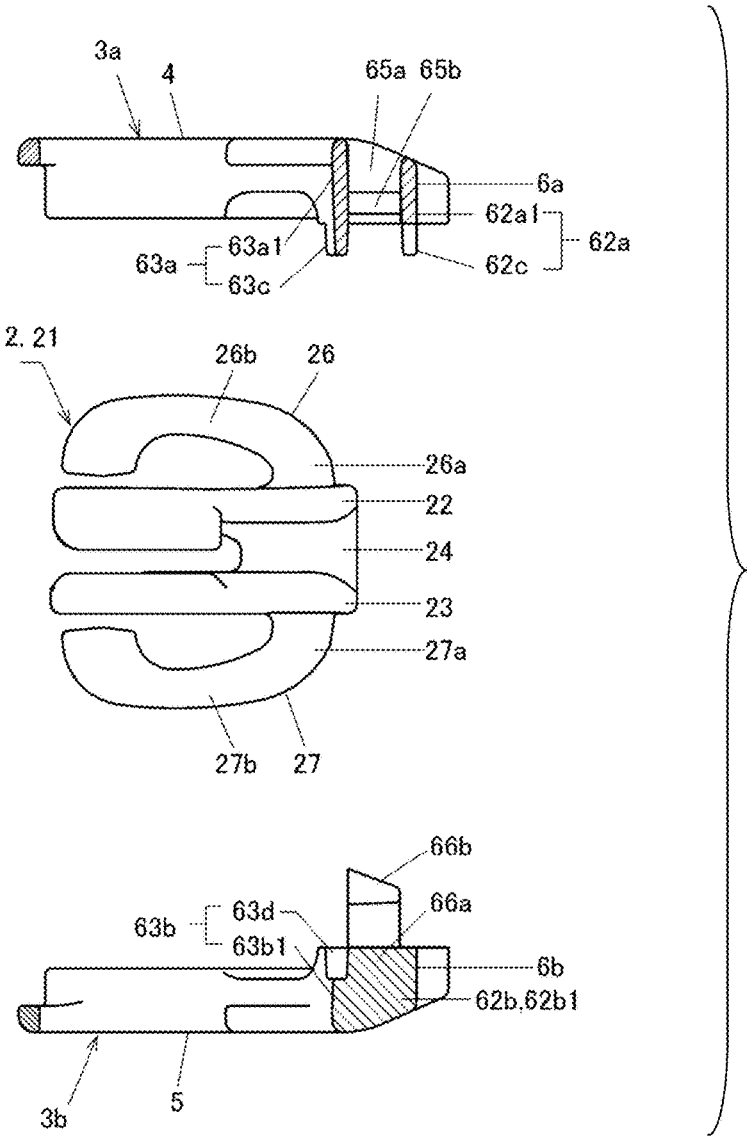
FIG. 7 is a side view depicting a state before the slide cover in accordance with the first illustrative embodiment is mounted to the slider.

Also, as shown in FIGS. 2 and 7, the slider body 21 is provide at its parts with the upper and lower pull tab attachment portions 26, 27. The upper pull tab attachment portion 26 has a protruding portion 26*a* protruding upward from an upper surface of the upper blade 22 and a bent portion 26*b* bent rearward from an end of the protruding portion 26*a*, and a tip end of the bent portion 26*b* is bent further downward and faces toward the upper blade 22. In the meantime, the lower pull tab attachment portion 27 also has a protruding portion 27*a* protruding downward from a lower surface of the lower blade 23 and a bent portion 27*b* bent rearward from the protruding portion 27*a*, and a tip end of the bent portion 27*b* is further bent and faces toward the lower blade 23. The upper and lower pull tab attachment portions 26, 27 are formed with through-holes 26*h*, 27*h* penetrating in the right and left direction, respectively. Parts of the upper and lower pull tabs 29, 29 are inserted into the through-holes 26*h*, 27*h*, so that the respective pull tabs 29 are connected to the slider body 21.

As shown in FIG. 1, the first end stops 8 are fixed to front end portions of the respective tapes 11. More specifically, the first end stops are fixed in front of the element rows 12 with an interval. Also, the first end stops 8 are thicker than the elements 13 in the upper-lower direction and a front surface of the slider 2 collides with the same.

The second end stop 9 is fixed to rear end portions of the two tapes 11, 11. More specifically, the second end stop is fixed further rearward than both the element rows 12, 12 with an interval. Also, in the first illustrative embodiment, the second end stop 9 is referred to as a separable end stop and has a separable pin 9*a* fixed to one of the two tapes 11, 11 and a retainer box 9*b* fixed to the other. The retainer box 9*b* has a separable pin hole (not shown) into which a rear portion of the separable pin 9*a* is inserted. The retainer box 9*b* is thicker than the elements 13 in the upper-lower direction, and a rear surface of the slider 2 collides with the same.

Figure 8:
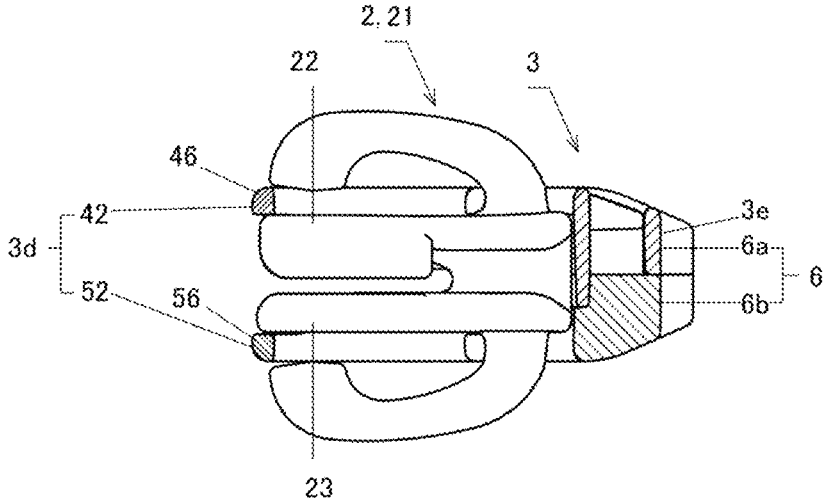
FIG. 8 is a side view depicting a state where the slide cover in accordance with the first illustrative embodiment is mounted to the slider.
Figure 9:
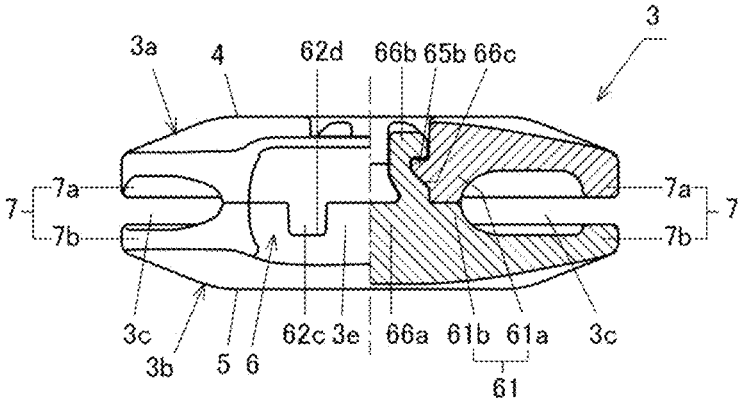
FIG. 9 is a sectional view depicting a state where the slide cover in accordance with the first illustrative embodiment is mounted to the slider.

As shown in FIGS. 1 and 2, the slide cover 3 of the first illustrative embodiment of the present invention has an upper member 3*a* and a lower member 3*b* arranged in the upper-lower direction, and is configured by connecting the upper member 3*a* and the lower member 3*b* at central portions in the right and left direction of front portions thereof. Also, as shown in FIGS. 2, 8 and 9, the slide cover 3 has a connection post 6 provided at a connection portion of the upper member 3*a* and the lower member 3*b*, a pair of element guide passages 3*c*, 3*c* provided at right and left sides of the connection post 6, through which the pair of separated element rows 12, 12 are to pass, as an internal space, and a mounting portion 3*d* for mount to the slider 2 at the rear of the connection post 6. In the meantime, the element guide passages 3*c* of the slide cover 3 are also referred to as second element guide passages 3*c*.

Figure 3:
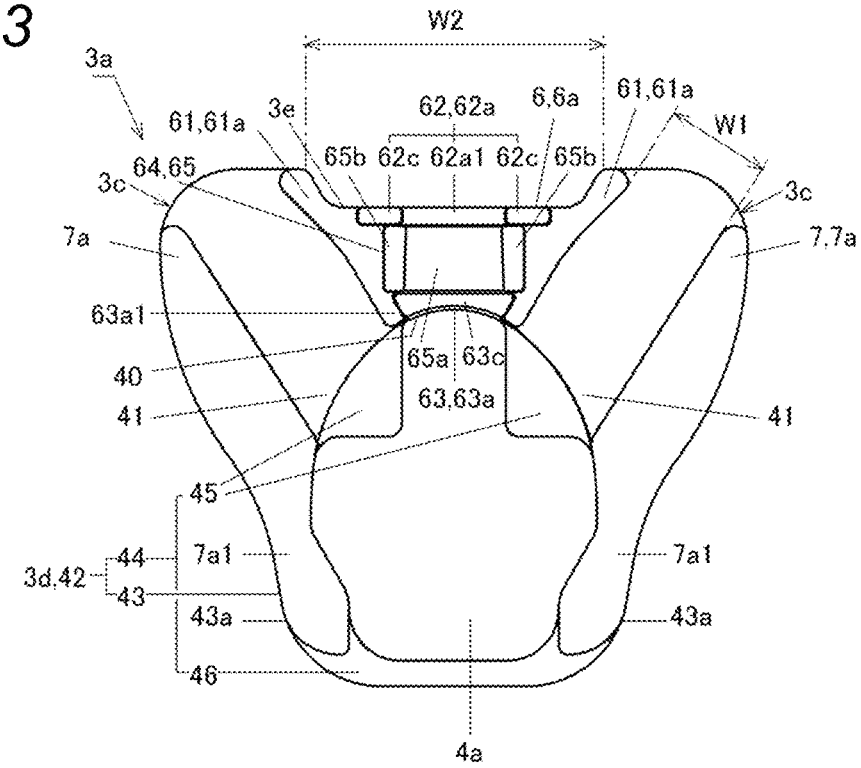
FIG. 3 is a bottom view depicting an upper member of the slide cover in accordance with the first illustrative embodiment.
Figure 4:
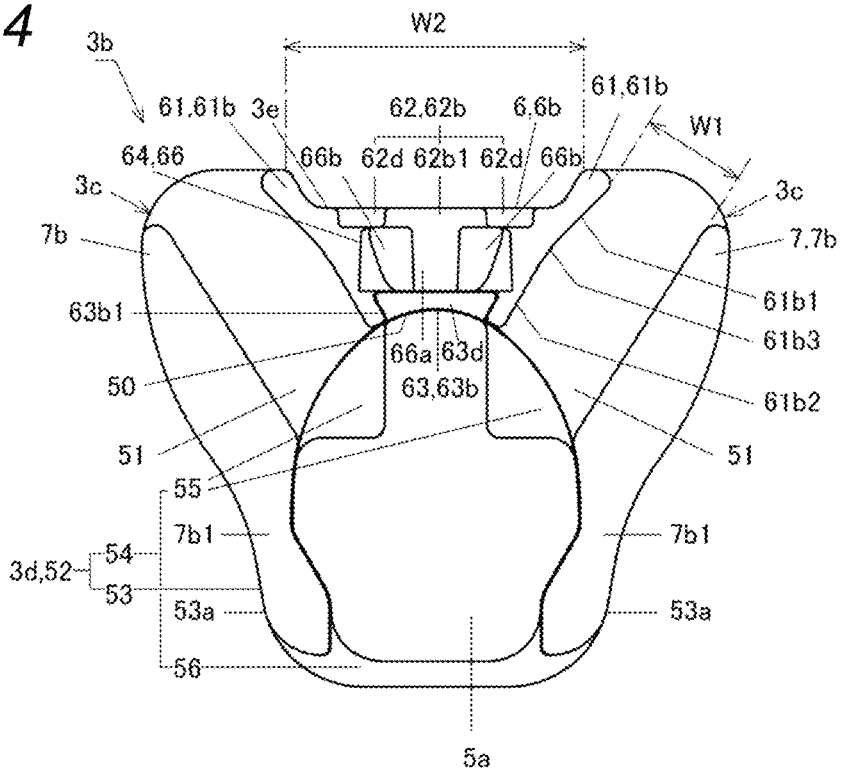
FIG. 4 is a plan view depicting a lower member of the slide cover in accordance with the first illustrative embodiment.
Figure 5:
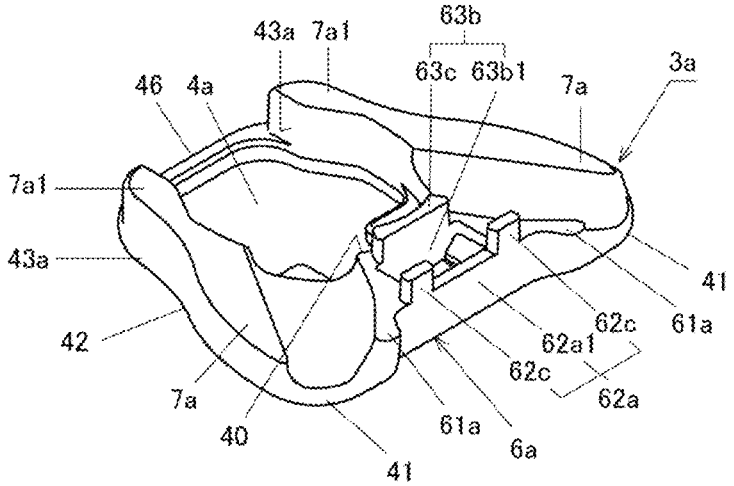
FIG. 5 is a perspective view of the upper member of the slide cover in accordance with the first illustrative embodiment, as seen from the lower surface-side.
Figure 6:
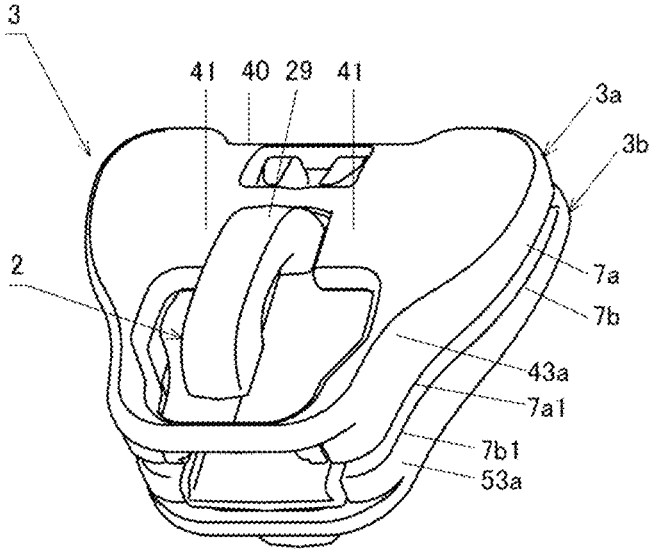
FIG. 6 is a perspective view depicting a state where the slide cover in accordance with the first illustrative embodiment is mounted to a slider.

As shown in FIGS. 2, 3 and 5, the upper member 3*a* has an upper plate 4. In the meantime, as shown in FIGS. 2 and 4, the lower member 3*b* has a lower plate 5.

The upper plate 4 and the lower plate 5 are formed so that width dimensions in the right and left direction and dimensions in the front-rear direction are greater than a width dimension in the right and left direction and a dimension in the front-rear direction of the slider 2. Also, the upper plate 4 and the lower plate 5 are formed so that the width dimensions in the right and left direction are greater at a front side than at a rear side. Also, since the upper plate 4 and the lower plate 5 are symmetric in the right and left direction, right and left side surfaces thereof have a shape where the right and left side surfaces get close to the central portion in the right and left direction toward the rear side. Also, at a state where the slide cover 3 is mounted to the slider 2, the upper plate 4 and the lower plate 5 are greater at the front side than at the rear side with respect to protruding lengths in the front-rear direction relative to the slider 2 (refer to FIG. 10).

The upper plate 4 has a pair of upper guide portions 41, 41 configured to guide the upper surfaces-side of the pair of element rows 12, 12, an upper bonding portion 40 for bonding the pair of upper guide portions 41, 41 in the width direction, and an upper portion of an upper mounting portion 42 formed in cooperation with the pair of upper guide portions 41, 41 and the upper bonding portion 40 and configured to mount the upper plate 4 to the upper blade 22. The pair of upper guide portions 41, 41 mainly configures right and left side portions of the front portion of the upper plate 4, the upper bonding portion 40 mainly configures a central portion in the right and left direction of the front portion of the upper plate 4, and the upper portion of the upper mounting portion 42 configures a rear portion of the upper plate 4.

The upper member 3*a* has a pair of upper outer wall portions 7*a*, 7*a* configured to guide opposite sides (outer sides in the width direction) of the pair of element rows 12, 12 to the engaging portion-sides, an upper post 6*a* configuring an upper portion of the connection post 6, and a pair of upper outer wall extension portions 7*a*1 configured to cover outer sides in the width direction of the pair of upper flanges 25, 25 of the slider 2, in addition to the upper plate 4. The pair of upper outer wall portions 7*a*, 7*a* protrudes downward from right and left end portions of the upper plate 4 (both outer end portions in the width direction of the pair of upper guide portions 41, 41), and the upper post 6*a* protrudes downward from the upper bonding portion 40. Also, the pair of upper outer wall extension portions 7*a*1 extends rearward from both outer end portions in the width direction of the pair of upper outer wall portions 7*a*, 7*a* at a lower end portion of the upper mounting portion 42.

The lower plate 5 has a pair of lower guide portions 51, 51 configured to guide the lower surfaces-side of the pair of element rows 12, 12 (more specifically, in the first illustrative embodiment, the lower surfaces-side of the pair of tapes 11, 11 arranged below the pair of element rows 12, 12), a lower bonding portion 50 for bonding the pair of lower guide portions 51, 51 in the width direction, and a lower portion of a lower mounting portion 52 formed in cooperation with the pair of lower guide portions 51, 51 and the lower bonding portion 50 and configured to mount the lower plate 5 to the lower blade 23. The pair of lower guide portions 51, 51 mainly configures right and left side portions of the front portion of the lower plate 5, the lower bonding portion 50 mainly configures a central portion in the right and left direction of the front portion of the lower plate 5, and the lower portion of the lower mounting portion 52 configures a rear portion of the lower plate 5.

The lower member 3*b* has a pair of lower outer wall portions 7*b*, 7*b* configured to guide the opposite sides (outer sides in the width direction) of the pair of element rows 12, 12 to the engaging portion-sides, a lower post 6*b* configuring a lower portion of the connection post 6, and a pair of lower outer wall extension portions 7*b*1, 7*b*1 configured to cover outer sides in the width direction of the pair of lower flanges 25, 25 of the slider 2, in addition to the lower plate 5. The pair of lower outer wall portions 7*b*, 7*b* protrudes upward from right and left end portions of the lower plate 5 (both outer end portions in the width direction of the pair of lower guide portions 51, 51), and the lower post 6*b* protrudes upward from the lower bonding portion 50. Also, the pair of lower outer wall extension portions 7*b*1, 7*b*1 extends rearward from both outer end portions in the width direction of the pair of lower outer wall portion 7*b*, 7*b* at an upper end portion of the lower mounting portion 52.

The upper outer wall portions 7*a* and the lower outer wall portions 7*b* face each other at the right and left sides of the slide cover 3 with an interval in the upper-lower direction. By the upper outer wall portion 7*a* and the lower outer wall portion 7*b* facing each other, an outer wall portion 7 is formed. Also, the outer wall portion 7 has a gap formed between a lower surface of the upper outer wall portion 7*a* and an upper surface of the lower outer wall portion 7*b*, through which the tape 11 is to pass.

An inner surface of each outer wall portion 7 is configured to guide an opposite side of each element row 12 to the engaging portion-side. As shown in FIG. 4, as seen from the upper surface-side of the lower plate 5 in the upper-lower direction, an inner surface shape (an inner side shape in the width direction) of each lower outer wall portion 7*b* is one linear shape inclined toward an inner side in the width direction toward the rear side. Also, as shown in FIG. 3, as seen from the lower surface-side of the upper plate 4 in the upper-lower direction, the inner surface shape of each upper outer wall portion 7*a* is symmetrical to the lower outer wall portion 7*b* with respect to the upper-lower direction. Therefore, as seen in the upper-lower direction, the inner surface shape of each outer wall portion 7 is one linear shape.

The upper post 6*a* and the lower post 6*b* are connected, so that the connection post 6 is formed. The connection post 6 is provided between the upper bonding portion 40 of the upper plate 4 and the lower bonding portion 50 of the lower plate 5, so that the upper member 3*a* and the lower member 3*b* are integrated. Also, the upper post 6*a* and the lower post 6*b* overlap with each other in the front-rear and right and left directions without a gap in the upper-lower direction. Right and left side portions of the connection post 6 are a pair of inner wall portions 61, 61 configured to respectively guide the engaging portion-sides (inner sides in the width direction) of the pair of element rows 12, 12. The pair of inner wall portions 61, 61 is formed by a pair of upper inner wall portions 61*a*, 61*a* configuring right and left side portions of the upper post 6*a* and a pair of lower inner wall portions 61*b*, 61*b* configuring right and left side portions of the lower post 6*b*.

Each inner wall portion 61 is configured to guide the element row 12 by an inner surface thereof (an outer surface in the width direction). As shown in FIG. 4, as seen from the upper surface-side of the lower plate 5 in the upper-lower direction, an inner surface shape (an outer side shape in the width direction) of the lower inner wall portion 61*b* is a shape where it goes toward an inner side in the width direction as it goes rearward, as a whole, and a front side (tip end portion-side in the engaging direction) comes close to a rear side (the disengaging direction-side) with respect to the inner surface shape of the lower outer wall portion 7*b*. More specifically, as seen in the upper-lower direction, the inner surface shape of the lower inner wall portion 61*b* is a bent shape including a first linear portion 61*b*1 arranged at the front side (the engaging direction-side), a second linear portion 61*b*2 arranged at the rear side (the disengaging direction-side), and an arc-shaped curve portion 61*b*3 smoothly connecting the first and second linear portions 61*b*1, 61*b*2. As shown in FIG. 4, the first linear portion 61*b*1 is more horizontal (further inclined toward the inner side in the width direction toward the rear side) than the inner surface shape of the inclined lower outer wall portion 7*b*, and the second linear portion 61*b*2 is parallel with the inner surface shape of the lower outer wall portion 7*b*. Therefore, regarding an interval W1 between the inner surface shape of the lower inner wall portion 61*b* and the inner surface shape of the lower outer wall portion 7*b*, the front side (tip end portion-side in the engaging direction) is narrower than the rear side. Herein, the "interval" indicates an interval in a direction orthogonal to the extension direction of the inner surface shape of the lower outer wall portion 7*b*, as seen in the upper-lower direction. Also, as shown in FIG. 3, as seen from the lower surface-side of the upper plate 4 in the upper-lower direction, the inner surface shape of the upper outer wall portion 7*a* is symmetrical to the inner surface shape of the lower outer wall portion 7*b* with respect to the upper-lower direction. Therefore, each of the second element guide passages 3*c* is narrower at the front side (tip end portion-side in the engaging direction) than at the rear side (the disengaging direction-side) with respect to the interval W1 between the outer wall portion 7 and the inner wall portion 61 facing each other.

Also, the front end (tip end in the engaging direction) of each inner wall portion 61 is located at a front side relative to the front end of the outer wall portion 7. Therefore, the front side of the second element guide passage 3*c* has a shape opening toward an outer side in the width direction.

The pair of element guide passages 3*c*, 3*c* is internal spaces surrounded by the pair of upper guide portions 41, 41, the pair of lower guide portions 51, 51, the pair of inner wall portions 61, 61 and the pair of outer wall portions 7, 7. When the slider 2 moves in the engaging direction, the pair of element guide passages 3*c*, 3*c* guides the pair of separated element rows 12, 12 into the slider 2, and when the slider 2 moves in the disengaging direction, the pair of element guide passages guides the pair of separated element rows 12, 12 in the slider 2 in the disengaging direction, as they are.

As described above, the connection post 6 has the upper post 6*a* and the lower post 6*b*. The upper post 6*a* and the lower post 6*b* are integrated, so that the connection post 6 forms the pair of inner wall portions 61, 61 configuring right and left side surfaces of the connection post, a front wall portion 62 configuring a front surface of the connection post, a rear wall portion 63 configuring a rear surface of the connection post, and a connection portion 64 configuring a central portion in the front-rear and right and left directions of the connection post.

The connection portion 64 has an upper connection portion 65 configuring an upper side thereof and a lower connection portion 66 configuring a lower side thereof.

The upper connection portion 65 has a connection hole 65*a* formed at a central portion in the right and left direction of the upper plate 4 and penetrating a front portion (the upper bonding portion 40 bonding the pair of upper guide portions 41, 41) in the upper-lower direction and right and left engaging pieces 65*b*, 65*b* protruding from right and left sides of a lower portion of the connection hole 65*a* in a direction along which an interval in the width direction is narrowed. The connection hole 65*a* has a rectangular shape, as seen in the upper-lower direction. Also, each engaging piece 65*b* has a horizontal upper surface and an inclined lower surface inclined downward toward an outer side in the width direction.

The lower connection portion 66 protrudes upward from the lower bonding portion 50 of the lower plate 5, and has a base 66*a* bridging between the pair of lower inner wall portions 61*b*, 61*b* and a pair of engaging posts 66*b*, 66*b* protruding upward from the base 66*a* with being spaced in the width direction, as shown in FIGS. 2, 4 and 9. An upper surface of the base 66*a* is flush with upper surfaces of the pair of lower inner wall portions 61*b*, 61*b*. Also, each engaging post 66*b* has an engaged piece 66*c* to be fitted to the corresponding engaging piece 65*b* at an intermediate portion in the upper-lower direction. When the right and left engaging posts 66*b*, 66*b* are inserted into the connection hole 65*a* from below, the engaged pieces 66*c* of the respective engaging posts 66*b* and the engaging pieces 65*b* are fitted each other and the upper connection portion 65 and the lower connection portion 66 are connected.

Figure 10:
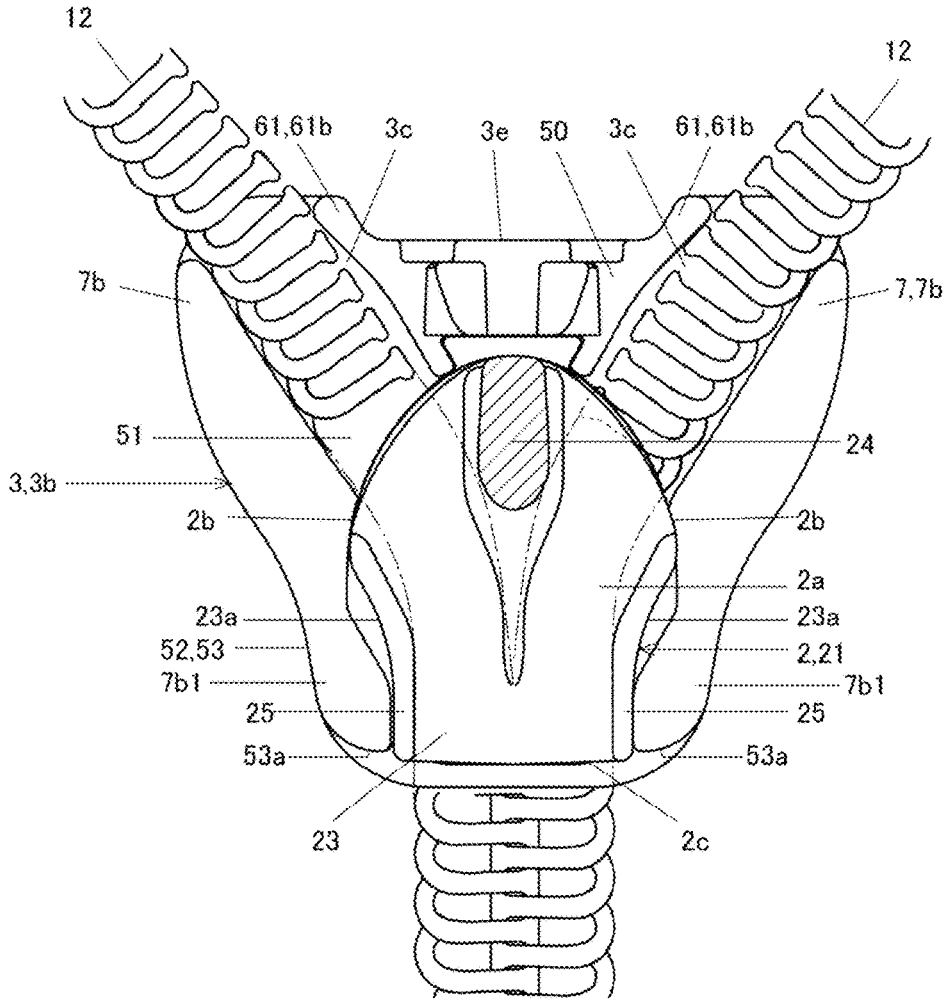
FIG. 10 depicts a relation between a pair of element rows and the slider having the slide cover of the first illustrative embodiment mounted thereto.
Figure 11:
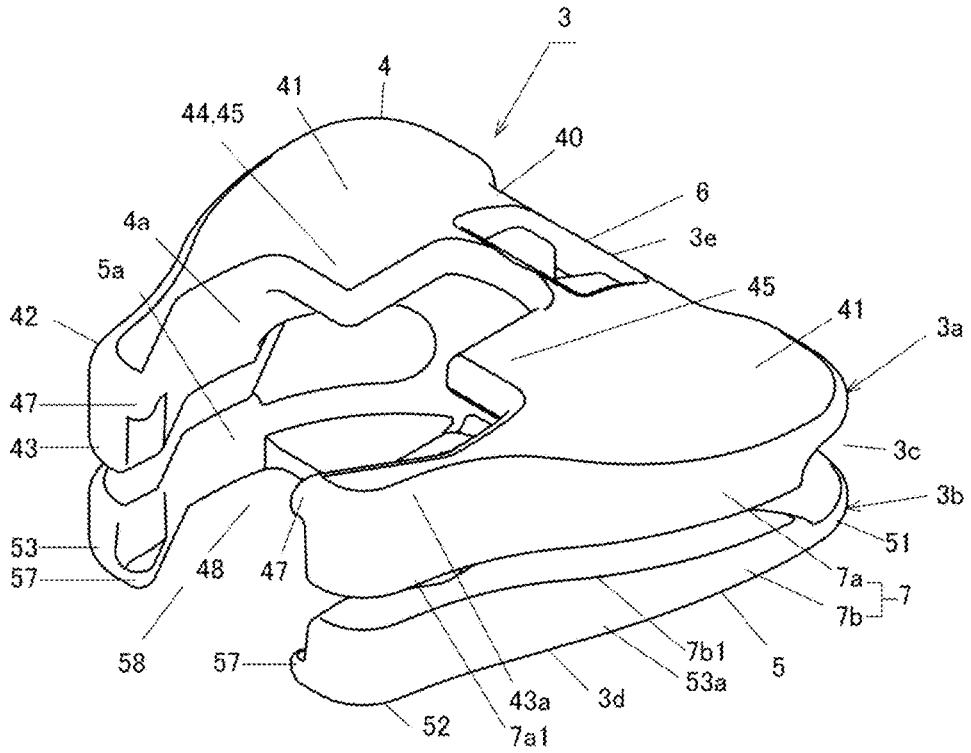
FIG. 11 is a perspective view depicting a slide cover in accordance with a second illustrative embodiment of the present invention.
Figure 12:
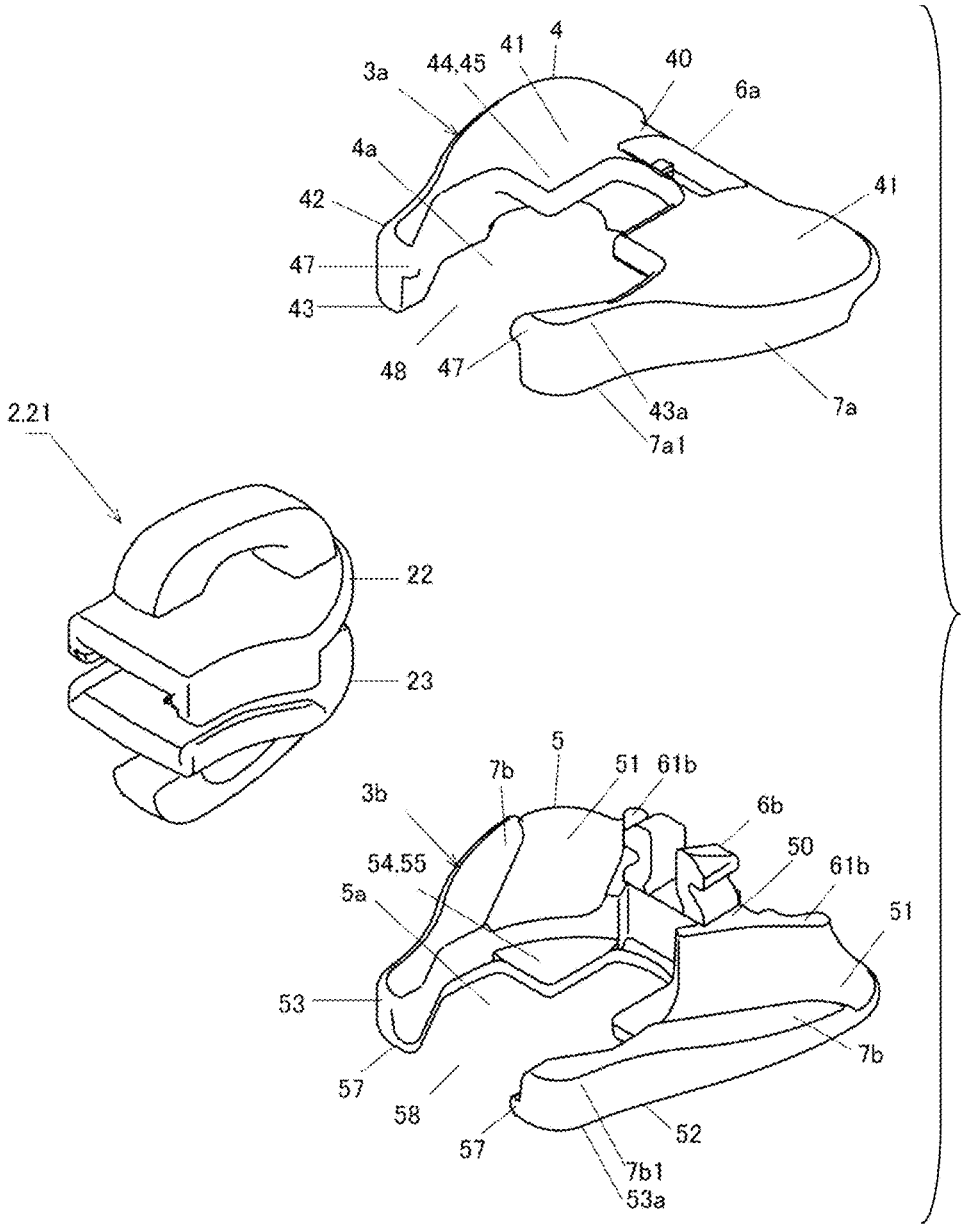
FIG. 12 is an exploded perspective view of the slide cover in accordance with the second illustrative embodiment.
Figure 13:
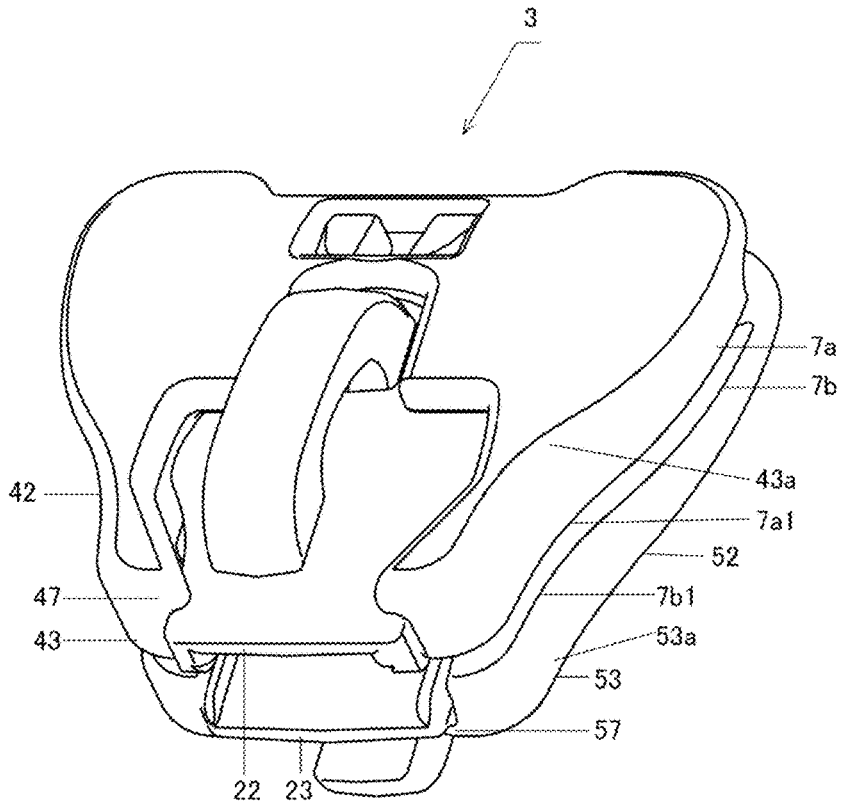
FIG. 13 is a perspective view depicting a state where the slide cover in accordance with the second illustrative embodiment is mounted to the slider.
Figure 14:
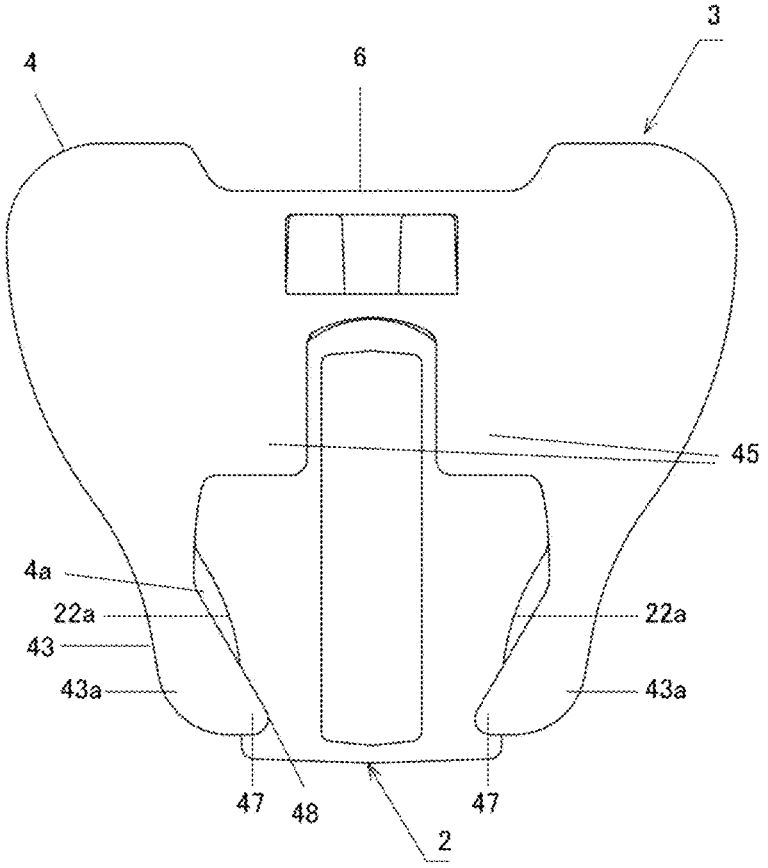
FIG. 14 is a plan view depicting a state where the slide cover in accordance with the second illustrative embodiment is mounted to the slider.
Figure 15:
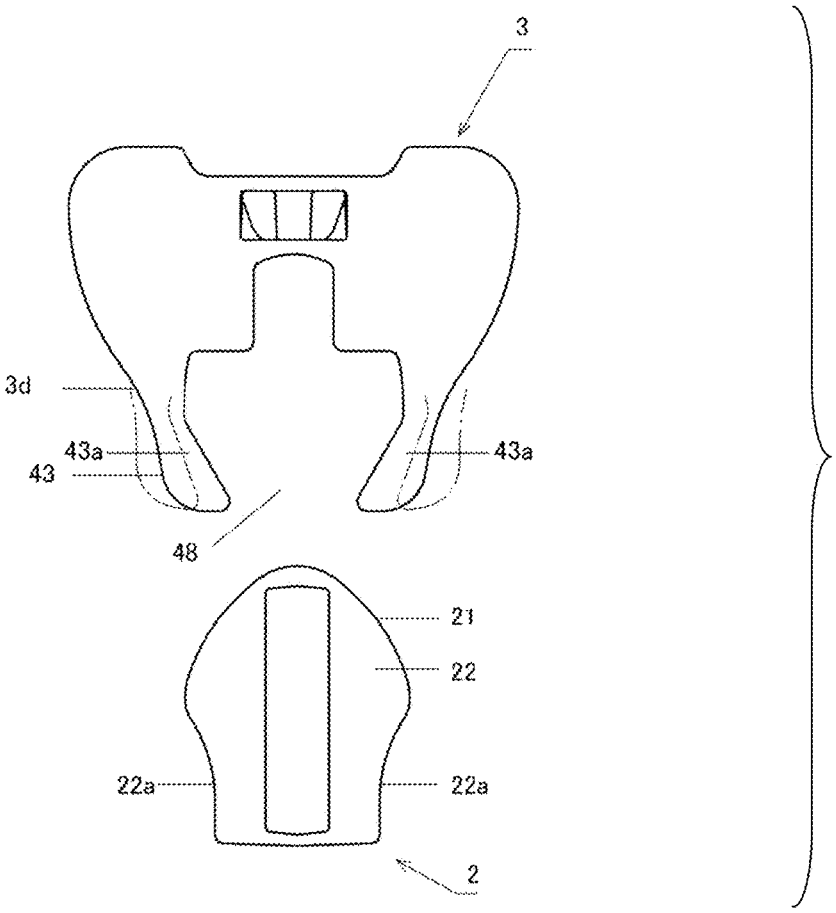
FIG. 15 is a plan view depicting a state before the slide cover in accordance with the second illustrative embodiment is mounted to the slider.

The upper plate 4, the lower plate 5 and the front wall portion 62 of the connection post 6 have a concave surface 3*e*, which is recessed rearward (in the disengaging direction of moving directions of the slider 2), in the front surface thereof (a surface facing toward the engaging direction of the moving directions of the slider 2). The concave surface 3*e* has a bottom surface recessed rearward relative to the front ends (tip ends in the engaging direction) of the pair of inner wall portions 61, 61 of the connection post 6 and a pair of side surfaces facing the pair of inner wall portions 61, 61 in the width direction. Also, the bottom surface of the concave surface 3*e* and both side surfaces are vertical surfaces continuing in the upper-lower direction. Also, the pair of side surfaces of the concave surface 3*e* extends from both sides in the width direction of the bottom surface of the concave surface 3*e*. More specifically, the pair of side surfaces of the concave surface 3*e* is configured as inclined surfaces gradually facing toward an inner side in the width direction from front ends (tip ends of the inner wall portions 61, 61), which are entries-side, towards rear ends, which are inner sides. Therefore, a dimension W2 in the width direction of the concave surface 3*e* gradually decreases toward the rear side (in the disengaging direction). Also, as shown in FIG. 10, since a maximum width dimension of the concave surface 3*e* is set to be equal or greater than a maximum width dimension of the slider 2, the cloth can be favorably guided.

Further, the bottom surface (front surface) of the concave surface 3*e* is configured as a surface parallel with the width direction, and a position thereof is located at the front side relative to the front ends of the outer wall portions 7, 7 and rearward relative to the front ends of the pair of inner wall portions 61, 61. Also, the front ends of the outer wall portions 7, 7 are located at the front side relative to the rear wall portion 63 of the connection post 6. By this configuration, it is possible to shorten a dimension of the slide cover 3 from the front end thereof to the bottom surface of the concave surface 3*e*. In the first illustrative embodiment, since the concave surface 3*e* is formed by a front surface of the front wall portion 62, a front surface of the upper plate 4 (upper bonding portion 40) and a front surface of the lower plate 5 (lower bonding portion 50), i.e., a front surface of the slide cover 3, a portion (front wall portion 62) of the connection post 6 of portions forming the concave surface 3*e* is hereinafter referred to as a concave wall portion 62. The concave wall portion 62 has an upper concave wall portion 62*a* configuring an upper side of the concave wall portion and a lower concave wall portion 62*b* configuring a lower side of the concave wall portion.

The upper concave wall portion 62*a* has an upper concave wall main body 62*a*1 bridged between front end portions of the pair of upper inner wall portions 61*a*, 61*a* and a lower surface of the upper concave wall main body 62*a*1 is flush with lower surfaces of the pair of upper inner wall portions 61*a*, 61*a*. In the meantime, the lower concave wall portion 62*b* has a lower concave wall main body 62*b*1 bridged between the pair of lower inner wall portions 61*b*, 61*b* at the front side of the base 66*a*, and an upper surface of the lower concave wall main body 62*b*1 is flush with upper surfaces of the pair of lower inner wall portions 61*b*, 61*b*. Also, the lower surface of the upper concave wall portion 62*a* and the upper surface of the lower concave wall portion 62*b* overlap with each other, and the lower concave wall portion 62*b* and the upper concave wall portion 62*a* are provided with first ridge portions 62*c* and first groove portions 62*d* to be fitted with each other in the upper-lower direction, separately. More specifically, the upper concave wall portion 62*a* has the two first ridge portions 62*c*, in addition to the upper concave wall main body 62*a*1. The two first ridge portions 62*c* protrude downward from the lower surface of the upper concave wall main body 62*a*1 and are formed with being spaced in the right and left direction. Also, the two first ridge portions 62*c* are formed so that outer ends thereof in the width direction are located outward relative to both ends in the width direction of the connection hole 65*a* formed at the lower plate 5 and inner ends thereof in the width direction are located inward relative to both ends in the width direction of the connection hole 65*a*. In the meantime, the lower concave wall portion 62*b* has two first groove portions 62*d* recessed rearward (the disengaging direction), in addition to the lower concave wall main body 62*b*1. The two first groove portions 62*d* are recessed downward from the upper surface of the lower concave wall main body 62*b*1 and are formed with an interval at right and left sides of the front surface of the lower concave wall main body 62*b*1. In the meantime, the rear of the first groove portion 62*d* is blocked by the base 66*a* located at the rear of the lower concave wall portion 62*b*.

The rear wall portion 63 has an upper rear wall portion 63*a* configuring an upper side thereof and a lower rear wall portion 63*b* configuring a lower side thereof. The upper rear wall portion 63*a* has an upper rear wall main body 63*a*1 bridged between the rear end portions of the pair of upper inner wall portions 61*a*, 61*a*, and a lower surface of the upper rear wall main body 63*a*1 is flush with the lower surfaces of the pair of upper inner wall portions 61*a*, 61*a*. In the meantime, the lower rear wall portion 63*b* has a lower rear wall main body 63*b*1 bridged between the pair of lower inner wall portions 61*b*, 61*b* at the front side of the base 66*a*, and an upper surface of the lower rear wall main body 63*b*1 is flush with the upper surfaces of the pair of lower inner wall portions 61*b*, 61*b*. Also, the lower surface of the upper rear wall portion 63*a* and the upper surface of the lower rear wall portion 63*b* overlap with each other, and the lower rear wall portion 63*b* and the upper rear wall portion 63*a* are provided with a second ridge portion 63*c* and a second groove portion 63*d* to be fitted with each other in the upper-lower direction, separately. More specifically, the upper rear wall portion 63*a* has the one second ridge portion 63*c*, in addition to the upper rear wall main body 63*a*1. The second ridge portion 63*c* protrudes downward from the lower surface of the upper rear wall main body 63*a*1. The lower rear wall portion 63*b* has the one second groove portion 63*d* recessed rearward (the disengaging direction), in addition to the lower rear wall main body 63*b*1. The second groove portion 63*d* is recessed downward from the upper surface of the lower rear wall main body 63*b*1 and is formed in the rear surface of the lower rear wall main body 63*b*1. In the meantime, the front of the second groove portion 63*d* is blocked by the base 66*a* located at the front side of the lower rear wall portion 63*b*. The rear wall portion 63 (connection post 6) is provided at its rear with the mounting portion 3*d* to be mounted to the slider 2, as described above.

The mounting portion 3*d* is to accommodate therein the slider body 21, and has the upper mounting portion 42 configured to mount the slide cover 3 to the upper blade 22 and the lower mounting portion 52 configured to mount the slide cover 3 to the lower blade 23. The upper mounting portion 42 and the lower mounting portion 52 are symmetric with respect to the upper-lower direction.

The lower mounting portion 52 has a lower surrounding portion 53 configured to surround an outer periphery of the lower blade 23 and outer peripheries of the pair of lower flanges 25 and a lower covering portion 54 protruding from the lower surrounding portion 53 and configured to cover the lower surface of the lower blade 23.

The lower surrounding portion 53 is a portion configured to surround a part (except for a rear part) of the outer periphery of the lower blade 23 and the outer peripheries (outer sides in the width direction) of the pair of lower flanges 25. The lower surrounding portion 53 has a portion configuring an outer side of the lower hole 5*a* formed in the lower plate 5 (hereinafter, referred to as "lower hole configuring portion") and a pair of lower outer wall extension portions 7*b*1, 7*b*1 protruding upward from both sides in the width direction of the lower hole configuring portion and protruding rearward from the pair of lower outer wall portions 7*b*, 7*b*.

The pair of lower outer wall extension portions 7*b*1, 7*b*1 configures an upper portion of the lower mounting portion 52 (an upper portion of the lower surrounding portion 53) and surrounds the outer peripheries (outer sides in the width direction) of the pair of lower flanges 25.

The lower hole configuring portion and the lower covering portion 54 configure a lower portion of the lower mounting portion 52 (including a lower portion of the lower surrounding portion 53) in cooperation with each other. Also, the lower hole configuring portion is configured to surround a part of the lower plate 5, i.e., a part (except for the rear part) of the outer periphery of the lower blade 23 and is configured by rear end portions of the pair of lower guide portions 51, 51, a rear end portion of the lower bonding portion 50 and a pair of lower leg portions 53*a*, 53*a* extending rearward from both outer end portions in the width direction of the pair of lower guide portions 51, 51. In the meantime, the pair of lower leg portions 53*a*, 53*a* and the pair of lower outer wall extension portions 7*b*1, 7*b*1 protruding upward therefrom have the same shape, as seen in the upper-lower direction.

The lower hole 5*a* forming an inner surface of the lower hole configuring portion is formed to penetrate a central portion in the width direction of the lower plate 5 in the upper-lower direction at the rear of the connection post 6. Also, a shape of the lower hole 5*a* (an inner surface shape of the lower hole configuring portion) is different between an upper portion and a lower portion thereof, in the drawings. However, the shape of the upper portion is a basic shape. Therefore, hereinafter, when describing the shape of the lower hole 5*a*, it refers to the shape of the upper portion of the lower hole 5*a*. The shape of the lower hole 5*a* has substantially the same outline as an outline (outer periphery) of the lower blade 23, and is slightly greater than the outline of the lower blade 23. More specifically, in the shape of the lower hole 5*a*, the front portion thereof has substantially the same arc shape as an arc shape of the front surface of the lower blade 23. However, both ends in the width direction of the front portion of the lower hole are located rearward relative to portions corresponding to rear ends of the pair of shoulder mouths 2*b*, 2*b* of the slider 2 (front ends of the pair of lower flanges 25, 25) and are also located outward in the width direction relative to both ends in the width direction of the pair of lower flanges 25, 25. In the shape of the lower hole 5*a*, the rear portion thereof is configured so that it is gradually inclined toward an inner side in the width direction from both ends in the width direction of the front portion as it goes rearward, and so that it extends in parallel with the front-rear direction. That is, the rear of the lower hole 5*a* is opened. An opening width of the rear portion of the lower hole 5*a* is substantially the same as a width dimension of the rear portion of the lower blade 23. Therefore, the lower hole 5*a* surrounds the outer periphery (except for the rear surface) of the lower blade 23, has a C shape opening rearward, and interposes the rear portion of the lower blade 23 in the width direction. In other words, the pair of lower leg portions 53*a*, 53*a* opens rearward therebetween, an interval in the width direction between the pair of lower leg portions 53*a*, 53*a* is narrower at the rear portion than at the front portion, and the rear portion of the lower blade 23 (the pair of concave portions 23*a*, 23*a*) is interposed between the rear portions of the pair of lower leg portions 53*a*, 53*a*. Also, the pair of lower outer wall extension portions 7*b*1, 7*b*1 also opens rearward therebetween, and the pair of lower flanges 25, 25 is interposed between the rear portions of the pair of lower outer wall extension portions 7*b*1, 7*b*1. In the meantime, the interval in the width direction between the rear portions of the pair of lower leg portions 53*a*, 53*a* and the interval in the width direction between the rear portions of the pair of lower outer wall extension portions 7*b*1, 7*b*1 are set to be narrower than the maximum dimension in the width direction of the slider 2 (lower blade 23).

Also, the lower covering portion 54 protrudes from the lower portion of the lower hole 5*a* so as to narrow the lower hole 5*a* and to block the rear opening. The lower covering portion 54 has a pair of lower protruding portions 55, 55 protruding from the pair of lower guide portions 51, 51 so as to narrow the lower hole 5*a* and a lower bar portion 56 protruding so as to block the rear opening of the lower hole 5*a*. More specifically, the pair of lower protruding portions 55, 55 protrudes rearward from lower portions of rear surfaces of the pair of lower guide portions 51, 51 and a lower portion of a rear surface of the lower bonding portion 50 with being spaced in the width direction. The interval in the width direction between the pair of lower protruding portions 55, 55 is set to a dimension for interposing the pull tab attachment portion 27 (protruding portion 27*a*) protruding from the lower surface of the lower blade 23. In each lower protruding portion 55, an inner surface thereof in the width direction is a planar surface extending in the front-rear direction, and a rear surface thereof is a planar surface extending in the width direction. Also, each lower protruding portion 55 has a substantially triangular shape where a front end of the inner surface in the width direction and an outer end of the rear surface in the width direction are interconnected to be convex into an arc shape.

Also, the lower bar portion 56 is bridged in the width direction between the rear portions of the lower portions of the pair of lower leg portions 53*a*, 53*a*. Therefore, the lower plate 5 is configured so that the rear of the lower hole 5*a* is blocked by the lower bar portion 56, as seen in the upper-lower direction. The lower bar portion 56 bridges over and covers the lower of the rear end portion of the lower blade 23 in the width direction at the rear of the lower pull tab attachment portion 27 (the rear end of the bent portion 27*b*). Also, the lower pull tab 29 is put on a lower surface of the lower bar portion 56.

The upper mounting portion 42 has a vertically symmetrical configuration to the lower mounting portion 52, and is configured by respective portions of which names "upper" and "lower" are respectively replaced with "lower" and "upper" of names of the respective portions configuring the lower mounting portion 52. That is, the upper mounting portion 42 has an upper surrounding portion 43 configured to surround a part of an outer periphery of the upper blade 22 and outer peripheries of the pair of upper flanges 25 and an upper covering portion 44 protruding from the upper surrounding portion 43 and configured to cover the upper surface of the upper blade 22.

The upper surrounding portion 43 is a portion configured to surround a part (except for a rear part) of the outer periphery of the upper blade 22 and the outer peripheries (outer sides in the width direction) of the pair of upper flanges 25. The upper surrounding portion 43 has a portion configuring an outer side of the upper hole 4*a* formed in the upper plate 4 (hereinafter, referred to as "upper hole configuring portion") and a pair of upper outer wall extension portions 7*a*1, 7*a*1 protruding downward from both sides in the width direction of the upper hole configuring portion and protruding rearward from the pair of upper outer wall portions 7*a*, 7*a*.

The pair of upper outer wall extension portions 7*a*1, 7*a*1 configures a lower portion of the upper mounting portion 42 (a lower portion of the upper surrounding portion 43) and surrounds the outer peripheries (outer sides in the width direction) of the pair of upper flanges 25, 25.

The upper hole configuring portion and the upper covering portion 44 configure an upper portion of the upper mounting portion 42 (an upper portion of the upper surrounding portion 43) in cooperation with each other. Also, the upper hole configuring portion is configured to surround a part of the upper plate 4, i.e., a part (except for the rear part) of the outer periphery of the upper blade 22 and is configured by rear end portions of the pair of upper guide portions 41, 41, a rear end portion of the upper bonding portion 40 and a pair of upper leg portions 43*a*, 43*a* extending rearward from both outer end portions in the width direction of the pair of upper guide portions 41, 41. In the meantime, the pair of upper leg portions 43*a*, 43*a* and the pair of upper outer wall extension portions 7*a*1, 7*a*1 protruding downward have the same shape, as seen in the upper-lower direction. In the meantime, an interval in the width direction between the rear portions of the pair of upper leg portions 43*a*, 43*a* and an interval in the width direction between the rear portions of the pair of upper outer wall extension portions 7*a*1, 7*a*1 are set to be narrower than the maximum dimension in the width direction of the slider 2 (upper blade 22).

The upper hole 4*a* forming an inner surface of the upper hole configuring portion is formed to penetrate a central portion in the width direction of the upper plate 4 in the upper-lower direction at the rear of the connection post 6. Also, a shape of the upper hole 5*a* (inner surface shape of the upper hole configuring portion) is different between an upper portion and a lower portion thereof, in the drawings. However, the shape of the lower portion is a basic shape. Therefore, hereinafter, when describing the shape of the upper hole 4*a*, it refers to the shape of the lower portion of the upper hole 4*a*. The shape of the upper hole 4*a* has substantially the same outline as an outline (outer periphery) of the upper blade 22, and is slightly greater than the outline of the upper blade 22. More specifically, in the shape of the upper hole 4*a*, the front portion thereof has substantially the same arc shape as an arc shape of the front surface of the upper blade 22. However, both ends in the width direction of the front portion of the upper hole are located rearward relative to portions corresponding to rear ends of the pair of shoulder mouths 2*b*, 2*b* of the slider 2 (front ends of the pair of upper flanges 25, 25) and are also located outward in the width direction relative to both ends in the width direction of the pair of upper flanges 25, 25. In the shape of the upper hole 4*a*, the rear portion thereof is configured so that it is gradually inclined toward an inner side in the width direction from both ends in the width direction of the front portion as it goes rearward, and so that it extends in parallel with the front-rear direction. That is, the rear of the upper hole 4*a* is opened. An opening width of the rear portion of the upper hole 4*a* is substantially the same as a width dimension of the rear portion of the upper blade 22. Therefore, the upper hole 4*a* surrounds the outer periphery (except for the rear surface) of the upper blade 22, has a C shape opening rearward, and interposes the rear portion of the upper blade 22 in the width direction. In other words, the pair of upper leg portions 43*a*, 43*a* opens rearward therebetween, an interval in the width direction between the pair of upper leg portions 43*a*, 43*a* is narrower at the rear portion than at the front portion, and the rear portion of the upper blade 22 (the pair of concave portions 22*a*, 22*a*) is interposed between the rear portions of the pair of upper leg portions 43*a*, 43*a*. Also, the pair of upper outer wall extension portions 7a1, 7a1 also opens rearward therebetween, and the pair of upper flanges 25, 25 is interposed between the rear portions of the pair of upper outer wall extension portions 7a1, 7a1.

Also, the upper covering portion 44 protrudes from the upper portion of the upper hole 4a so as to narrow the upper hole 4a and to block the rear opening. The upper covering portion 44 has a pair of upper protruding portions 45, 45 protruding from the pair of upper guide portions 41, 41 so as to narrow the upper hole 4a and an upper bar portion 46 protruding so as to block the rear of the upper hole 4a. More specifically, the pair of upper protruding portions 45, 45 protrudes rearward from upper portions of rear surfaces of the pair of upper guide portions 41, 41 and an upper portion of a rear surface of the upper bonding portion 40 with being spaced in the width direction. The interval in the width direction between the pair of upper protruding portions 45, 45 is set to a dimension for interposing the pull tab attachment portion 26 (protruding portion 26a) protruding from the upper surface of the upper blade 22. In each upper protruding portion 45, an inner surface thereof in the width direction is a planar surface extending in the front-rear direction, and a rear surface thereof is a planar surface extending in the width direction. Also, each upper protruding portion 45 has a substantially triangular shape where a front end of the inner surface in the width direction and an outer end of the rear surface in the width direction are interconnected to be convex into an arc shape.

Also, the upper bar portion 46 is bridged in the width direction between the rear portions of the upper portions of the pair of upper leg portions 43a, 43a. Therefore, the upper plate 4 is configured so that the rear of the upper hole 4a is blocked by the lower bar portion 56, as seen in the upper-lower direction. The upper bar portion 46 bridges over and covers the upper of the rear end portion of the upper blade 22 in the width direction at the rear of the upper pull tab attachment portion 26 (the rear end of the bent portion 26b). Also, the upper pull tab 26 is put on an upper surface of the upper bar portion 46.

As shown in FIG. 7, the slide cover 3 of the first illustrative embodiment is integrally configured by arranging the upper member 3a and the lower member 3b above and below the slider 2, respectively, and connecting the upper post 6a of the upper member 3a and the lower post 6b. Also, the connection post 6 is connected by the connection portion 64 and has the first groove portion 62d and the first ridge portion 62c positioned at the front side of the connection portion 64 and the second groove portion 63d and the second ridge portion 63c positioned at the rear side of the connection portion 64. The bottoms-side of the first and second groove portions 62d, 63d are blocked by the base 66a. Therefore, even though a force of separating the upper plate 4 and the lower plate 5 from the end portions of the rear sides (the disengaging direction-side) of the upper plate 4 and the lower plate 5 in the upper-lower direction is applied so as to separate the upper plate 4 and the lower plate 5, since the bottom surfaces (surfaces facing toward the engaging direction) of the respective groove portions 62d, 63d and the respective ridge portions 62c, 63c are in contact with each other, the upper concave wall portion 62a and the lower concave wall portion 62b are difficult to separate from each other, so that the connection strength between the upper plate 4 and the lower plate 5 is improved.

Also, the slider 2 is accommodated in the connected slide cover 3, the upper blade 22 is mounted to the upper mounting portion 42, and the lower blade 23 is mounted to the lower mounting portion 52. More specifically, the upper blade 22 is accommodated in the upper surrounding portion 43 of the slide cover 3, and the lower blade 23 is accommodated in the lower surrounding portion 53. The upper surface of the upper blade 22 is covered by the upper covering portion 44 and the upper bar portion 46, the lower surface of the lower blade 23 is covered by the lower covering portion 54 and the lower bar portion 56, and the slider body 21 is interposed in the upper-lower direction. Also, the upper blade 22 and the lower blade 23 except for the rear sides thereof are covered by the upper surrounding portion 43 and the lower surrounding portion 53, and the front surfaces and the right and left side surfaces of the rear portions of the upper blade 22 and the lower blade 23 are in contact with the upper surrounding portion 43 and the lower surrounding portion 53. Also, the upper blade 22 and the concave portions 22a of the pair of upper flanges 25, 25 are interposed by the pair of upper leg portions 43a, 43a and the pair of upper outer wall extension portions 7a1, 7a1, and the lower blade 23 and the concave portions 23a of the pair of lower flanges 25, 25 are interposed by the pair of lower leg portions 53a, 53a and the pair of lower outer wall extension portions 7b1, 7b1. Also, a part (protruding portion 26a) of the upper pull tab attachment portion 26 is interposed between the pair of upper protruding portions 45, 45 and a part (protruding portion 27a) of the lower pull tab attachment portion 27 is interposed between the pair of lower protruding portions 55, 55, so that the slide cover 3 is positioned with respect to the slider 2. By the positioning, positions of the pair of shoulder mouths 2b, 2b and the pair of second guide element passages 3c, 3c are determined, so that it is possible to easily guide the pair of element rows 12, 12 into the element guide passage 2a of the slider 2. In the first illustrative embodiment, as shown in FIG. 10, the rear ends of the inner surfaces of the pair of inner wall portions 61, 61 (the pair of lower inner wall portions 61b, 61b) are located outward relative to the right and left ends of the guide post 24 of the slider 2 and the rear ends of the inner surfaces of the pair of outer wall portions 7, 7 (the lower outer wall portions 7b) are located upward relative to the front ends of the pair of lower flanges 25, 25 of the slider 2, so that it is possible to easily guide the pair of element rows 12, 12 into the slider 2.

Also, the interval between the outer wall portion 7 and inner wall portion 61 in each second element guide passage 3c, which face each other, becomes narrower toward the tip end portion-side in the engaging direction relative to the disengaging direction-side. Therefore, it is possible to easily guide the pair of element rows 12, 12 into the slider 2 while making it difficult for the cloth around the slide fastener F to be jammed.

Also, the connection post 6 has the concave surface 3e formed in the front surface and recessed rearward. Therefore, upon the moving of the slider 2 in the engaging direction, when the cloth is between the pair of element rows 12, 12, the cloth moves toward the concave surface 3e, so that the cloth is difficult to be jammed. Also, the tip ends of the inner surfaces of the pair of inner wall portions 61, 61 in the engaging direction are located at the same positions as the tip ends of the inner surfaces of the pair of outer wall portions 7, 7 in the engaging direction or located at the side of the engaging direction relative to the tip ends of the inner surfaces of the pair of outer wall portions in the engaging direction. Therefore, when the slide fastener F is opened by pulling the pair of tapes 11, 11 toward both sides in the width direction, the sliding properties of the slider 2 are improved. Also, since the pair of outer wall portions 7, 7 is not formed with the concave surface 3e and the front surfaces of the pair of upper guide portions 41, 41 and the rear surfaces of the pair of lower guide portions 51, 51 are formed to be parallel in the right and left direction, the damage or injury is difficult to occur.

As shown in FIGS. 11 to 15, the slide cover 3 in accordance with a second illustrative embodiment of the present invention is different from the first illustrative embodiment, as to the shapes of the upper mounting portion 42 and the lower mounting portion 52.

In the second illustrative embodiment, the upper hole 4*a* configuring the upper mounting portion 42 opens rearward without being blocked not only at the lower portion thereof (the portion covering a part except for the rear portion of the outer periphery of the upper blade 22 and the portion covering the outer sides in the width direction of the pair of upper flanges 25, 25) but also at the upper portion thereof. Therefore, in the second illustrative embodiment, the upper bar portion 46 of the first illustrative embodiment is not provided. However, in the second illustrative embodiment, the upper covering portion 44 has the pair of upper protruding portions 45, 45 and a pair of upper convex portions 47, 47 configured to cover right and left sides of the rear end portion of the upper surface of the upper blade 22. The pair of upper convex portions 47, 47 protrudes inward in the width direction from the rear portions of the upper portions of the pair of upper leg portions 43*a*, 43*a* opening rearward. The pair of upper convex portions 47, 47 is spaced in the width direction. Therefore, as seen in the upper-lower direction, the upper plate 4 has an upper opening 48 by which the upper hole 4*a* opens rearward (the disengaging direction). By the upper opening 48, the pair of upper leg portions 43*a*, 43*a* and the pair of lower upper outer wall extension portions 7*a*1, 7*a*1 are separated from each other in the width direction at the rear portions thereof.

Also, the lower mounting portion 52 has a vertically symmetrical shape to the upper mounting portion 42. Therefore, in the second illustrative embodiment, the lower hole 5*a* configuring the lower mounting portion 52 opens rearward without being blocked not only at the upper portion thereof (the portion covering a part except for the rear portion of the outer periphery of the lower blade 23 and the portion covering the outer sides in the width direction of the pair of lower flanges 25, 25) but also at the lower portion thereof. Therefore, in the second illustrative embodiment, the lower bar portion 56 of the first illustrative embodiment is not provided. However, in the second illustrative embodiment, the lower covering portion 54 has the pair of lower protruding portion 55, 55 and a pair of lower convex portions 57, 57 configured to cover right and left sides of the rear end portion of the lower surface of the lower blade 23. The pair of lower convex portions 57, 57 protrudes inward in the width direction from the rear portions of the lower portions of the pair of lower leg portions 53*a*, 53*a* opening rearward. The pair of lower convex portions 57, 57 is spaced in the width direction. Therefore, as seen in the upper-lower direction, the lower plate 5 has a lower opening 58 by which the lower hole 5*a* opens rearward (the disengaging direction). By the lower opening 58, the pair of lower leg portions 53*a*, 53*a* and the pair of lower outer wall extension portions 7*b*1, 7*b*1 are separated from each other in the width direction at the rear portions thereof.

The slide cover 3 of the second illustrative embodiment is made of a synthetic resin or metal, for example, and has elasticity of the resin or metal. Since the pair of upper leg portions 43*a*, 43*a* and the pair of lower leg portions 53*a*, 53*a* have the upper opening 48 and the lower opening 58, when an external force is applied, it is possible to widen the interval in the width direction and when the external force is removed, it is possible to restore the shape to the original shape by the elasticity of the resin or metal. Therefore, when the slider 2 is pushed into the slide cover 3 from the rear, the widths of the upper opening 48 and the lower opening 58 are temporarily widened, so that the slider 2 is inserted between the pair of upper leg portions 43*a*, 43*a* and between the pair of lower leg portions 53*a*, 53*a*. Also, by the restoring force, the width of the upper opening 48 is restored to the original width, so that the upper blade 22 is interposed between the pair of upper leg portions 43*a*, 43*a* in the concave portions 22*a* and the pair of upper flanges 25, 25 is interposed between the pair of upper outer wall extension portions 7*a*1, 7*a*1 below the pair of upper leg portions 43*a*, 43*a*. Likewise, by the restoring force, the width of the lower opening 58 is restored to the original width, so that the lower blade 23 is interposed between the pair of lower leg portions 53*a*, 53*a* in the concave portions 22*a* and the pair of upper flanges 25, 25 is interposed between the pair of lower outer wall extension portions 7*b*1, 7*b*1 above the pair of lower leg portions 53*a*, 53*a*. Therefore, the pair of upper leg portions 43*a*, 43*a* has the elasticity of mounting the upper blade 22 therebetween in a snap manner and the pair of lower leg portions 53*a*, 53*a* has the elasticity of mounting the lower blade 23 therebetween in a snap manner. Likewise, the pair of upper outer wall extension portions 7*a*1, 7*a*1 and the pair of lower outer wall extension portions 7*b*1, 7*b*1 have the elasticity of mounting the pair of upper and lower flanges 25, 25 in a snap manner. Also, when the mounted slider 2 is moved rearward relative to the slide cover 3, the widths of the pair of upper leg portions 43*a*, 43*a* and the pair of lower leg portions 53*a*, 53*a* are temporarily widened by the elasticity, so that the slide cover 3 separates.

The present invention is not limited to the above illustrative embodiments, and can be appropriately changed without departing from the gist thereof. For example, in the above illustrative embodiments, the connection portion 64 is provided at its front side with the first groove portion 62*d* and the first ridge portion 62*c*, and the connection portion 64 is provided at its rear side with the second groove portion 63*d* and the second ridge portion 63*c*. However, the present invention is not limited thereto. For example, the first groove portion 62*d* and the first ridge portion 62*c* may not be provided or the second groove portion 63*d* and the second ridge portion 63*c* may not be provided.

Also, in the above illustrative embodiments, the pair of outer wall portions 7, 7 is configured by the pair of upper outer wall portions 7*a*, 7*a* and the pair of lower outer wall portions 7*b*, 7*b*. However, the present invention is not limited thereto. For example, the pair of outer wall portions may be configured only by one of the pair of upper outer wall portions 7*a*, 7*a* and the pair of lower outer wall portions 7*b*, 7*b*.

Also, in the above illustrative embodiments, the upper mounting portion 42 (upper surrounding portion 43) has the upper outer wall extension portion 7*a*1. However, the present invention is not limited thereto. For example, the upper mounting portion may not have the upper outer wall extension portion 7*a*1. In this case, the pair of upper flanges 25, 25 is not covered, and the upper mounting portion 42 is configured only by the upper plate 4. Likewise, in the above illustrative embodiments, the lower mounting portion 52 (lower surrounding portion 53) has the lower outer wall extension portion 7*b*1. However, the present invention is not limited thereto. For example, the lower mounting portion may not have the lower outer wall extension portion 7b1.

DESCRIPTION OF REFERENCE NUMERALS

F: Slide Fastener
12: Fastener Stringer
11: Tape
12: Element Row
12*a*: Engaging Portion
12*b*: Coil Reverse Portion
13: Element
2: Slider
2*a*: Element Guide Passage (First Element Guide Passage)
2*b*: Shoulder Mouth (Opening)
2*c*: Rear Mouth (Opening)
2*d*: Tape Groove
31: Slider Body
22: Upper Blade
22*a*: Concave Portion
23: Lower Blade
23*a*: Concave Portion
24: Guide Post
25: Flange
26: Upper Pull Tab Attachment Portion
26*a*: Protruding Portion
26*b*: Bent Portion
26*h*: Through-Hole
27: Lower Pull Tab Attachment Portion
27*a*: Protruding Portion
27*b*: Bent Portion
27*h*: Through-Hole
29: Pull Tab
3: Slide Cover
3*a*: Upper Member
3*b*: Lower Member
3*c*: Element Guide Passage (Second Element Guide Passage)
3*d*: Mounting Portion
3*e*: Concave Surface
4: Upper Plate
4*a*: Upper Hole
40: Upper Bonding Portion
41: Upper Guide Portion
42: Upper Mounting Portion
43: Upper Surrounding Portion
43*a*: Upper Leg Portion
44: Upper Covering Portion
45: Upper Protruding Portion
46: Upper Bar Portion
47: Upper Convex Portion
48: Upper Opening
5: Lower Plate
5*a*: Lower Hole
50: Lower Bonding Portion
51: Lower Guide Portion
52: Lower Mounting Portion
53: Lower Surrounding Portion
53*a*: Lower Leg Portion
54: Lower Covering Portion
55: Lower Protruding Portion
56: Lower Bar Portion
57: Lower Convex Portion
58: Lower Opening
6: Connection Post
6*a*: Upper Post
6*b*: Lower Post
61: Inner Wall Portion
61*a*: Upper Inner Wall Portion
61*b*: Lower Inner Wall Portion
61*b*1: First Linear Portion
61*b*2: Second Linear Portion
61*b*3: Curve Portion
62: Front Wall Portion (Concave Wall Portion)
62*a*: Upper Concave Wall Portion
62*a*1: Upper Concave Wall Main Body
62*b*: Lower Concave Wall Portion
62*b*1: Lower Concave Wall Main Body
62*c*: First Ridge Portion
62*d*: First Groove Portion
63: Rear Wall Portion
63*a*: Upper Rear Wall Portion
63*a*1: Upper Rear Wall Main Body
63*b*: Lower Rear Wall Portion
63*b*1: Lower Rear Wall Main Body
63*c*: Second Ridge Portion
63*d*: Second Groove Portion
64: Connection Portion
65: Upper Connection Portion
65*a*: Connection Hole
65*b*: Engaging Piece
66: Lower Connection Portion
66*a*: Base
66*b*: Engaging Post
66*c*: Engaged Piece
W1: Interval between Outer Wall Portion and Inner Wall Portion
W2: Dimension in Width Direction of Concave Surface
7: Outer Wall Portion
7*a*: Upper Outer Wall Portion
7*a*1: Upper Outer Wall Extension Portion
7*b*: Lower Outer Wall Portion
7*b*1: Lower Outer Wall Extension Portion
8: First End Stop
9: Second End Stop
9*a*: Separable Pin
9*b*: Retainer Box

The invention claimed is:

1. A slide cover for a slide fastener, to be mounted to a slider comprising a slider body having an upper blade and a lower blade arranged to face each other with an interval in an upper-lower direction, a guide post configured to connect front portions of the upper blade and the lower blade at intermediate portions thereof in a right and left direction, and a Y-shaped first element guide passage formed by the upper blade, the lower blade and the guide post, the slide cover comprising:

an upper plate to be mounted to the upper blade;

a lower plate to be mounted to the lower blade;

a connection post configured to connect the upper plate and the lower plate in the upper-lower direction and comprising a pair of inner wall portions configured to respectively guide engaging portion-sides of a pair of element rows of the slide fastener;

a pair of outer wall portions configured to respectively guide opposite sides of the pair of element rows to the engaging portion-sides and protruding from at least one of the upper plate and the lower plate so as to narrow an interval between the upper plate and the lower plate, and a pair of second guide element passages formed in a space among the upper plate, the lower plate, the pair of outer wall portions and the pair of inner wall portions and configured to guide the pair of separated element rows into the first element guide passage, wherein the upper plate, the lower plate and the connection post have a concave surface, which is recessed in a disengaging direction of moving directions of the slider, in a surface facing toward an engaging direction of the moving directions of the slider, and wherein the pair of second guide element passages are configured so that tip ends of the pair of inner wall portions in the engaging direction are located at the same positions as tip ends of the pair of outer wall portions in the engaging direction or located at a side of the engaging direction relative to the tip ends of the pair of outer wall portions in the engaging direction.

2. The slide cover for a slide fastener according to claim 1, wherein the pair of second guide element passages are configured so that intervals between the outer wall portions and the inner wall portions which face each other become narrower toward a tip end portion-side thereof in the engaging direction relative to a disengaging direction-side thereof.

3. The slide cover for a slide fastener according to claim 2, wherein as seen in the upper-lower direction, an inner surface shape of each of the outer wall portions is one linear shape, wherein an inner surface shape of each of the inner wall portions is a bent shape comprising a first linear portion arranged at the engaging direction-side and a second linear portion arranged at the disengaging direction-side, wherein the second linear portion has a shape parallel with the inner surface shape of each of the outer wall portions, and wherein the first linear portion has a shape inclined relative to the inner surface shape of each of the outer wall portions and coming close to each of the outer wall portions toward the tip end portion-side in the engaging direction.

4. The slide cover for a slide fastener according to claim 1, wherein the upper plate and the lower plate are configured as separate members, wherein the connection post has a concave wall portion forming the concave surface and a connection portion configured to connect the upper plate and the lower plate in the upper-lower direction at a side of the disengaging direction relative to the concave wall portion, wherein the concave wall portion has an upper concave wall portion configuring an upper side of the concave surface and protruding downward from the upper plate and a lower concave wall portion configuring a lower side of the concave surface and protruding upward from the lower plate, wherein the upper concave wall portion and the lower concave wall portion overlap with each other in the upper-lower direction, overlapping surfaces-side thereof are respectively provided with a first groove portion and a first ridge portion to be fitted to the first groove portion, and wherein the first groove portion and the first ridge portion are located at the side of the engaging direction relative to the connection portion.

5. The slide cover for a slide fastener according to claim 1, wherein the upper plate has an upper mounting portion to be mounted to the upper blade, wherein the upper mounting portion has an upper surrounding portion configured to surround a part of an outer periphery of the upper blade and an upper covering portion configured to cover at least a part of an upper surface of the upper blade, and wherein the upper surrounding portion constitutes an outer side of an upper hole penetrating the upper plate.

6. The slide cover for a slide fastener according to claim 5, wherein the slider comprises the slider body further having a pull tab attachment portion protruding from the upper surface of the upper blade, in addition to the upper blade, the lower blade, the guide post and the first element guide passage, wherein the upper covering portion has a pair of upper protruding portions protruding from the pair of second guide element passages of the upper plate so as to narrow the upper hole, and wherein an interval between the pair of upper protruding portions is set to a dimension within which the pull tab attachment portion provided on the upper surface-side of the upper blade is interposed.

7. The slide cover for a slide fastener according to claim 1, wherein the lower plate has a lower mounting portion to be mounted to the lower blade, wherein the lower mounting portion has a lower surrounding portion configured to surround a part of an outer periphery of the lower blade and a lower covering portion configured to cover at least a part of a lower surface of the lower blade, and wherein the lower surrounding portion constitutes an outer side of a lower hole penetrating the lower plate.

8. The slide cover for a slide fastener according to claim 7, wherein the slider comprises the slider body having a pull tab attachment portion protruding from the lower surface of the lower blade, in addition to the upper blade, the lower blade, the guide post and the first element guide passage, wherein the lower covering portion has a pair of lower protruding portions protruding from the pair of second guide element passages so as to narrow the lower hole, and wherein an interval between the pair of lower protruding portions is set to a dimension within which the pull tab attachment portion provided on the lower surface-side of the lower blade is interposed.

9. The slide cover for a slide fastener according to claim 1, wherein the upper plate has a pair of upper guide portions configured to guide upper surfaces-side of the pair of element rows, an upper bonding portion bonding the pair of upper guide portions, and an upper mounting portion formed in cooperation with the pair of upper guide portions and the upper bonding portion and configured to mount the upper plate to the upper blade, wherein the upper mounting portion has a pair of upper leg portions protruding from the pair of upper guide portions in the disengaging direction and configured to interpose the upper blade therebetween, in addition to the pair of upper guide portions and the upper bonding portion, wherein the lower plate has a pair of lower guide portions configured to guide lower surfaces-side of the pair of element rows, a lower bonding portion bonding the pair of lower guide portions, and a lower mounting portion formed in cooperation with the pair of lower guide portions and the lower bonding portion and configured to mount the lower plate to the lower blade, wherein the lower mounting portion has a pair of lower leg portions protruding from the pair of lower guide portions in the disengaging direction and configured to interpose the lower blade therebetween, in addition to the pair of lower guide portions and the lower bonding portion, and wherein the pair of upper leg portions and the pair of lower leg portions have elasticity so that the upper blade and the lower blade are to be mounted therebetween in a snap manner, respectively.

* * * * *